US006051921A

United States Patent [19]

Beeteson et al.

[11] Patent Number: 6,051,921

[45] Date of Patent: Apr. 18, 2000

[54] MAGNETIC MATRIX DISPLAY DEVICE AND COMPUTER SYSTEM FOR DISPLAYING DATA THEREON

[75] Inventors: John Beeteson; Andrew Ramsey Knox, both of Ayrshire, United Kingdom

[73] Assignee: International Business Machines Corporation

[21] Appl. No.: 08/950,119

[22] Filed: Oct. 14, 1997

[30] Foreign Application Priority Data

Apr. 5, 1997 [GB] United Kingdom ..... 9706692

[51] Int. Cl.[7] ..... H01J 29/74; H01J 29/70; H01F 07/00; H01F 01/00

[52] U.S. Cl. ..... 313/433; 313/421; 313/422; 313/429; 313/431; 313/495; 335/210; 335/212

[58] Field of Search ..... 313/421, 422, 313/420, 429–30, 431, 433, 442, 495, 458; 335/210, 212; 345/55, 74–76, 86–87

[56] References Cited

FOREIGN PATENT DOCUMENTS 60-093742 5/1985 Japan .

2304981 3/1997 United Kingdom ..... H01J 3/02

WO9708726 3/1997 WIPO .

WO9708730 3/1997 WIPO .

*Primary Examiner*—Kenneth J. Ramsey

*Assistant Examiner*—Mack Haynes

*Attorney, Agent, or Firm*—Jay P. Sbrollini

[57] ABSTRACT

A magnet for use in a magnetic matrix display has a two dimensional array of apertures between opposite poles of the magnet. The direction of the magnetic field is such that the magnet generates, in each channel, a collimating magnet field for forming electrons from a cathode into an electron beam. A 'keeper', area around the periphery of the magnet is used to improve the linearity of the field strength in the apertures from apertures at the center of the magnet to apertures at the periphery of the magnet. The 'keeper', area may have control circuits placed on the surface of that area of the magnet. The keeper area may contain apertures which are not used for collimation and into which electrons are prevented from entering by a grid electrode or by a physical blocking means.

10 Claims, 25 Drawing Sheets

900

MAGNETIC MATRIX DISPLAY DEVICE AND COMPUTER SYSTEM FOR DISPLAYING DATA THEREON

FIELD OF THE INVENTION

The present invention relates to a magnetic matrix display device and more particularly to a magnet for use in such a display. Yet more particularly, the present invention linearises the magnetic field around the edge of the magnet.

BACKGROUND OF THE INVENTION

A magnetic matrix display of the present invention is particularly although not exclusively useful in flat panel display applications such as television receivers and visual display units for computers, especially although not exclusively portable computers, personal organisers, communications equipment, and the like.

Conventional flat panel displays, such as liquid crystal display panels and field emission displays, are complicated to manufacture because they each involve a relatively high level of semiconductor fabrication, delicate materials, and high tolerances.

UK Patent Application 2304981 discloses a magnetic matrix display having a cathode for emitting electrons, a permanent magnet with a two dimensional array of channels extending between opposite poles of the magnet, the direction of magnetisation being from the surface facing the cathode to the opposing surface. The magnet generates, in each channel, a magnetic field for forming electrons from the cathode means into an electron beam.

The display also has a screen for receiving an electron beam from each channel, the screen having a phosphor coating facing the side of the magnet remote from the cathode, the phosphor coating comprising a plurality of pixels each corresponding to a different channel. There are grid electrode means disposed between the cathode means and the magnet for controlling flow of electrons from the cathode means into each channel. The two dimensional array of channels are regularly spaced on an X-Y grid. The magnet area is large compared with its thickness.

The permanent magnet is used to form substantially linear, high intensity fields in the channels or magnetic apertures for the purpose of collimating the electrons passing through the aperture. The diameter of the beam so formed is largely dependent on the flux density present in the apertures of the magnet. Changes in the aperture flux density across the magnet body will result in changes in the electron beam diameter in different areas of the display for identical electrical conditions. This will in turn interfere with the electron lensing such that the beam diameter when it strikes the phosphors under the final anode will be variable across the display surface. The visible manifestations will be changes in luminance uniformity, or in severe cases, a purity error.

SUMMARY OF THE INVENTION

In accordance with the present invention, there is now provided a display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating facing the side of the magnet remote from the cathode, the phosphor coating comprising a plurality of pixels each corresponding to a different channel; grid electrode means disposed between the cathode means and the magnet for controlling flow of electrons from the cathode means into each channel;

deflection means for sequentially addressing the electron beam from each channel to each pixel of a corresponding group; and wherein the magnet extends in at least a first dimension beyond the area occupied by said two dimensional array of channels such that the field strength in the channels at the periphery of the array is substantially equal to the field strength in channels at the centre of the array.

By extending the magnet beyond the area occupied by the two dimensional array of channels, the field strength in the channels at the periphery is maintained to a value substantially similar to the field strength in channels near to the centre of the two dimensional array of channels. The extended area reduces the tendency of the flux lines to take the 'easy' route of closure round the edge of the magnet in preference to closure through the apertures or channels. By making closure round the edge of the magnet more difficult, more of the flux lines close through the apertures and a flux density which is more uniform between apertures is provided.

Preferably, the magnet extends in a second dimension such that the two dimensional array of channels has a surrounding periphery of magnetic material. In a preferred embodiment, the size of the extended magnet is such that the channels at the periphery of the array of channels have substantially the same field strength within them as channels at the centre of the array of channels.

The invention will advantageously provide an improved uniformity of flux density when the magnet is extended in a single dimension only, but by providing a continuous surrounding periphery of extended magnet, a more uniform flux density is achieved for all of the array of channels. The size of the extended magnet is optimised through finite element (FE) modelling or through experiment until substantially the same field strength is obtained in channels at the periphery of the array of channels as in channels at the centre of the array of channels.

In a preferred embodiment, the channels are cylindrical in shape, and are between 75 $\mu$m and 225 $\mu$m in diameter, are spaced between 100 $\mu$m and 450 $\mu$m apart and the magnet is 0.5 mm to 2 mm in thickness.

More preferably, the extended magnet area has circuits for control of the display device located thereon. In a first embodiment of such a display device, the extended magnet area includes a portion of the array of channels, said portion of the array of channels having a grid electrode means disposed between the cathode means and the magnet for preventing the admission of electrons from the cathode to the portion of the array of channels. In a second embodiment of the display device, the extended magnet area includes a portion of the array of channels, said portion of the array of channels being physically blocked with non-magnetic material so as to prevent the admission of electrons from the cathode to the portion of the array of channels.

Electrical connections to the grids which are part of the display device may be easily made to circuits mounted on the extended magnet area. Additionally, driver circuits may be so arranged that the number of connections to the display which are required is reduced, resulting in a corresponding reduction in the number of connections which pass through the vacuum envelope of the magnetic matrix display.

The present invention extends to a computer system comprising: memory means; data transfer means for transferring data to and from the memory means; processor means for processing data stored in the memory means nd a display device as hereinbefore described for displaying data processed by the processor means.

BRIEF DESCRIPTION OF THE DRAWINGS

Preferred embodiments of the present invention will now be described, by way of example only, with reference to the accompanying drawings in which.

DETAILED DESCRIPTION OF THE PREFERRED EMBODIMENTS

Figure 1:
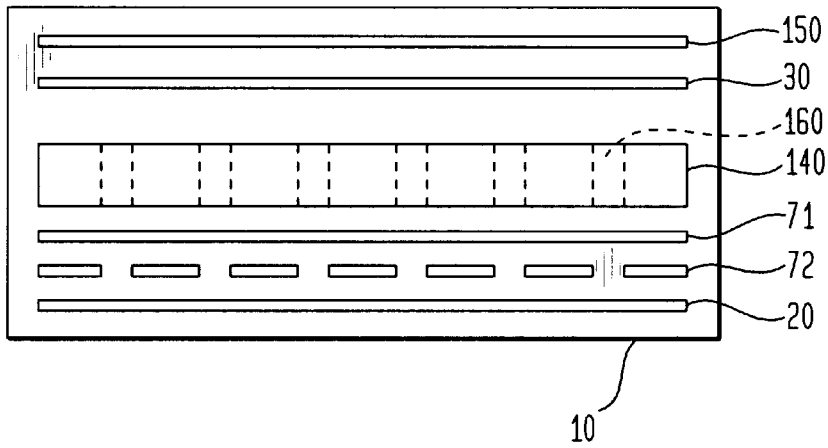
FIG. 1 is a simplified cross-sectional view of an example of a Magnetic Matrix Display device.

Referring to FIG. 1, an example of a magnetic matrix display device 10 comprises a plane cathode 20 facing a plane anode 30. A phosphor coating 150 is disposed on the side of the anode 30 remote from the cathode. A permanent magnet 140 is disposed between the anode 30 and the cathode 20. The magnet 140 is perforated by a two dimensional matrix of channels or "wells" 160. A grid assembly is disposed between the magnet 140 and the cathode 20. The grid assembly comprises first and second electrically isolated arrays of parallel conductors hereinafter referred to as first grids 71 and second grids 72 respectively. The first grids 71 are arranged orthogonally to the second grids 72 to form a lattice pattern. Apertures are formed in the first grids 71 and the second grids 72. The apertures are located at each intersection of a first grid 71 and a second grid 72. Each aperture is aligned with a different well 160.

Figure 2:
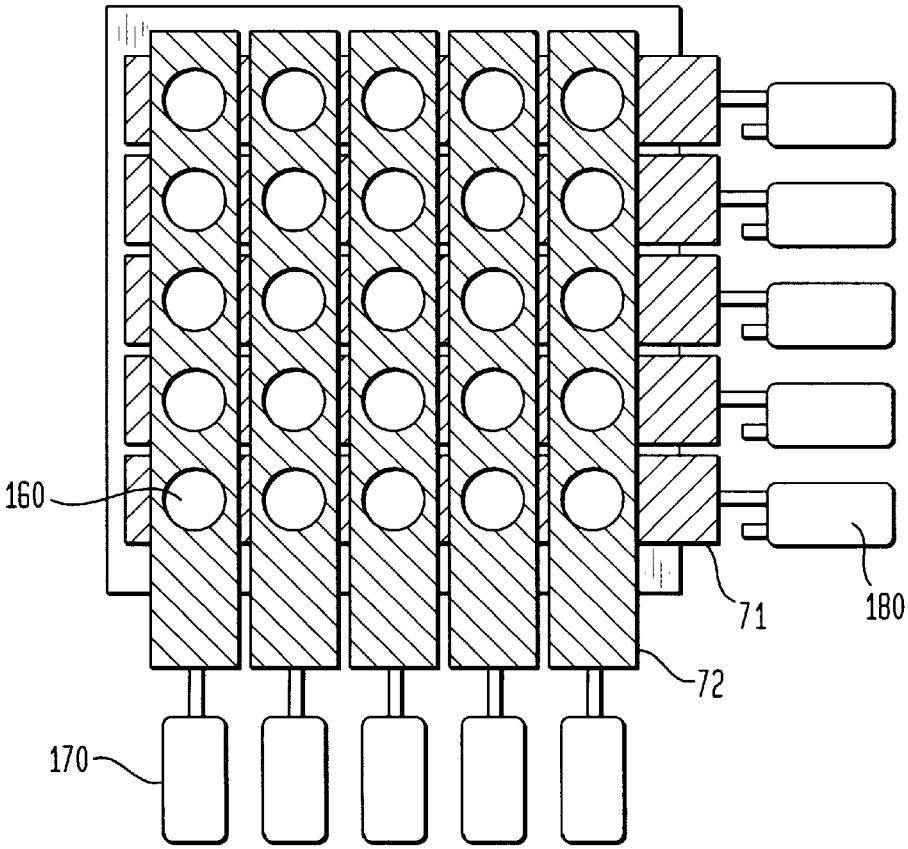
FIG. 2 is a cutaway plan view of the example of FIG. 1.

Referring to FIG. 2, column drive circuitry 170 is connected to the second grids 72. Row drive circuitry 180 is connected to the first grids 71. This has the advantage that for a conventional display having a four to three aspect ratio, with more columns than rows, the number of more complex expensive analog drivers is reduced at the cost of having more simple, cheap digital switches. In operation, the anode 30 is held at a higher potential than the cathode 20. Electrons emitted from the cathode 20 are thus accelerated towards the anode 30. As electrons enter each of the wells 160 in the magnet 140 they are collimated into a dense beam by the magnetic field therein. In operation, admittance of electrons to the wells is selectively controlled via the grid assembly. Each well 160 is addressable by appropriate voltage signals applied by the row drive circuitry 180 and the column drive circuitry 170 to the corresponding first grid 71 and second grid 72. Electrons are thus selectively admitted or blocked from entering each well 160, passing through the magnet 140 and reaching the corresponding region of the phosphor coating 150 to generate a pixel of a displayed image on the screen. The pixels of the displayed image are scanned in a refresh pattern. To produce the refresh pattern, a column of pixels is energised by applying an appropriate voltage, via the column drive circuitry 170 to the corresponding second grid 72 with the voltage on the first grids 71 set via the row drive circuitry 180 so that no beam current flows. The voltages on the remaining second grids 72 are set by the column drive circuitry 170 so that no beam current flows for any operating voltage on the first grids 71. The voltages on the first grids 71 are then modulated by row drive circuitry 180 as a function of input video data corresponding to the energised column of pixels. The process is then repeated for the next successive column. The row and column functions may be transposed relative to that conventionally used in LCDs, that is the rows are driven by an analog voltage and the columns are switched between two analog levels.

Before considering methods of equalising the aperture flux density across the active display area, it is first necessary to understand more fully the factors which influence this flux density. This is explored using a 3D finite element analysis software package to solve the equations for the fields in the magnet and in the space in which it resides.

Small finite magnet

Figure 3:
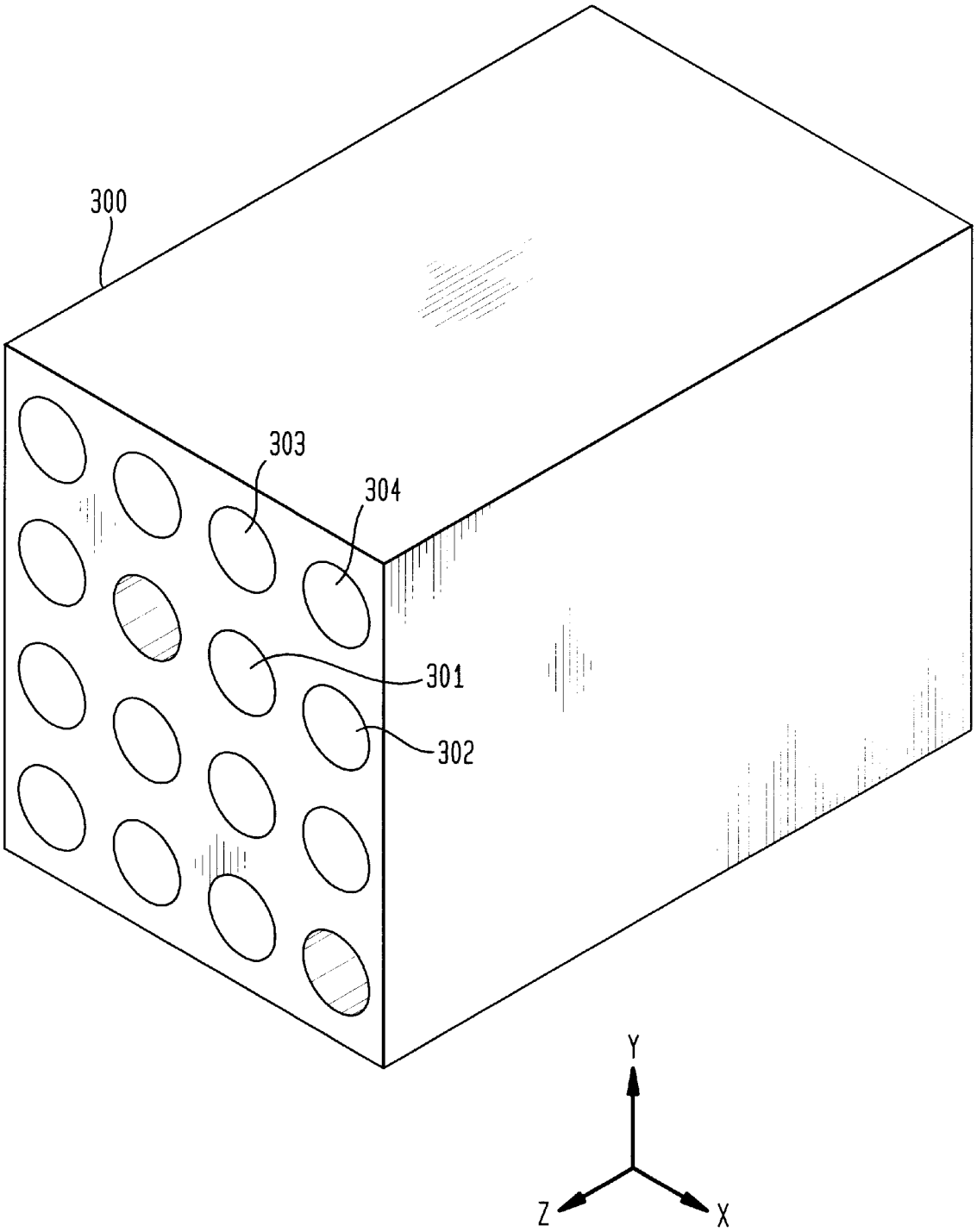
FIG. 3 is a view of a small magnet having 16 apertures.

FIG. 3 shows a small magnet 300 with 16 apertures 301–304 totally enclosed in a volume of air. The apertures 301–304 are arranged in a square grid at 300 $\mu$m centres.

Each aperture 301–304 is 200 $\mu$m in diameter. The magnet 300 is 2 mm thick. The boundaries of the volume of air used in this finite element (FE) model of a magnet are a long way from the magnet 300 to ensure that errors in the field calculation near the magnet 300 are minimised. In the FE model, the boundary conditions for the volume of air are set such that no flux leaks, from the volume of air. The values chosen for the thickness of the magnet and the aperture diameter are typical values and the present invention is not limited to applicability to magnets having only these dimensions.

Figure 4:
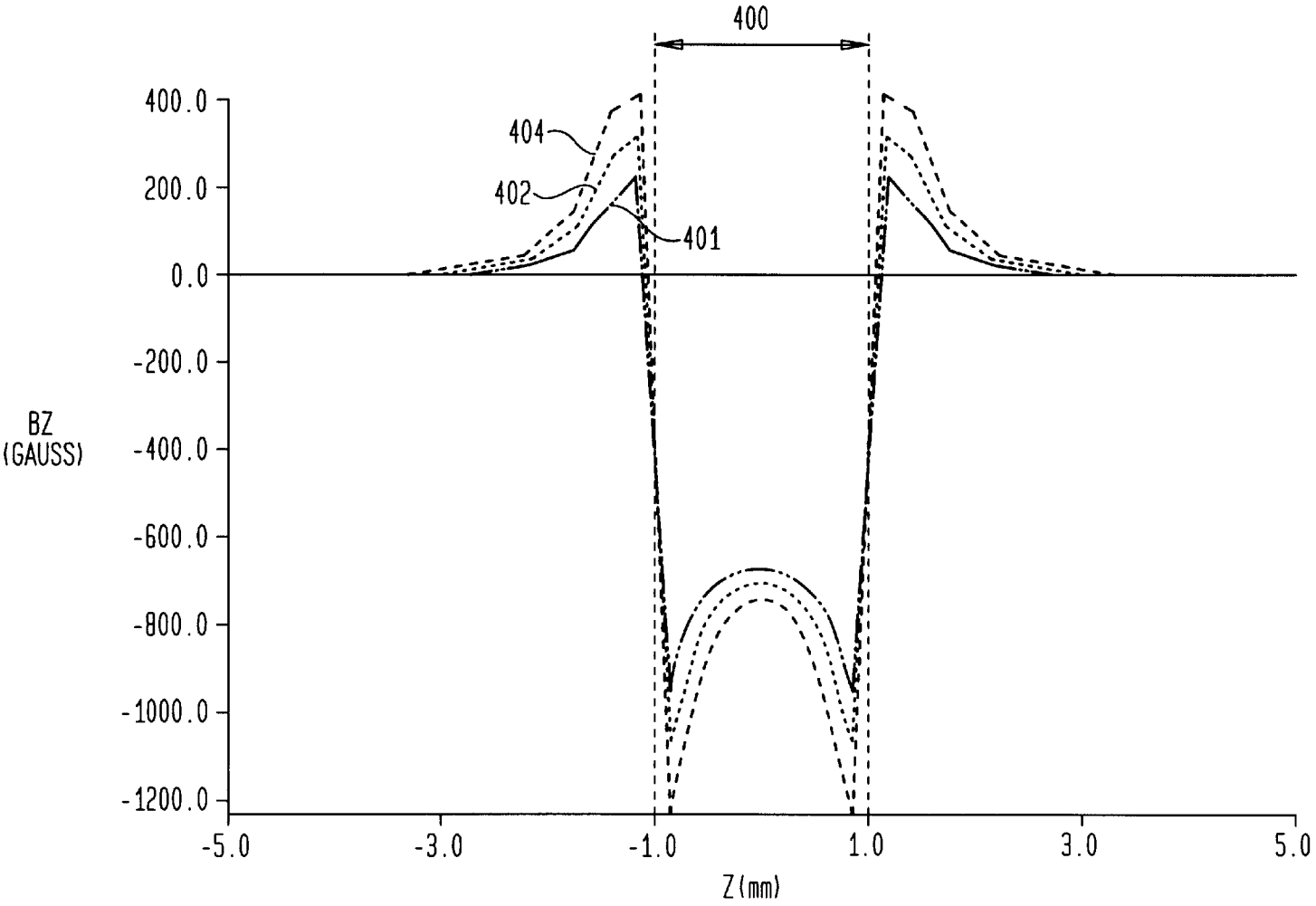
FIG. 4 is a graph of the magnetic flux density (BZ) along the Z axis of the magnet of FIG. 3.

FIG. 4 shows a graph of the Z-directed component of the magnetic flux density (BZ) in Gauss (G) versus the position along the Z axis in mm. 1 Gauss is equivalent to $10^{-4}$ Tesla (T), so the Y axis scale is equivalent to +0.04T to −0.12T. The 2 mm thick magnet of FIG. 3 is located along the horizontal axis of the graph in the area labelled as 400. The vertical dash lines at each end of the area labelled 400 represent the boundary between the magnet and the volume of air surrounding the magnet. The graph has three lines showing the variation of BZ through three different apertures of the magnet.

Line 401 shows the variation of BZ through aperture 301, lines 402 and 404 show the variation of BZ through apertures 302 and 304 respectively. By symmetry, the variation of BZ through aperture 303 is identical to that through aperture 302.

From FIG. 4 it can be seen that:

(i) the flux density in each of the apertures is markedly different;

(ii) each of the apertures has a flux density minimum in the centre of the aperture; and (iii) outside of each of the apertures there is a substantial variation in the field.

Figure 5:
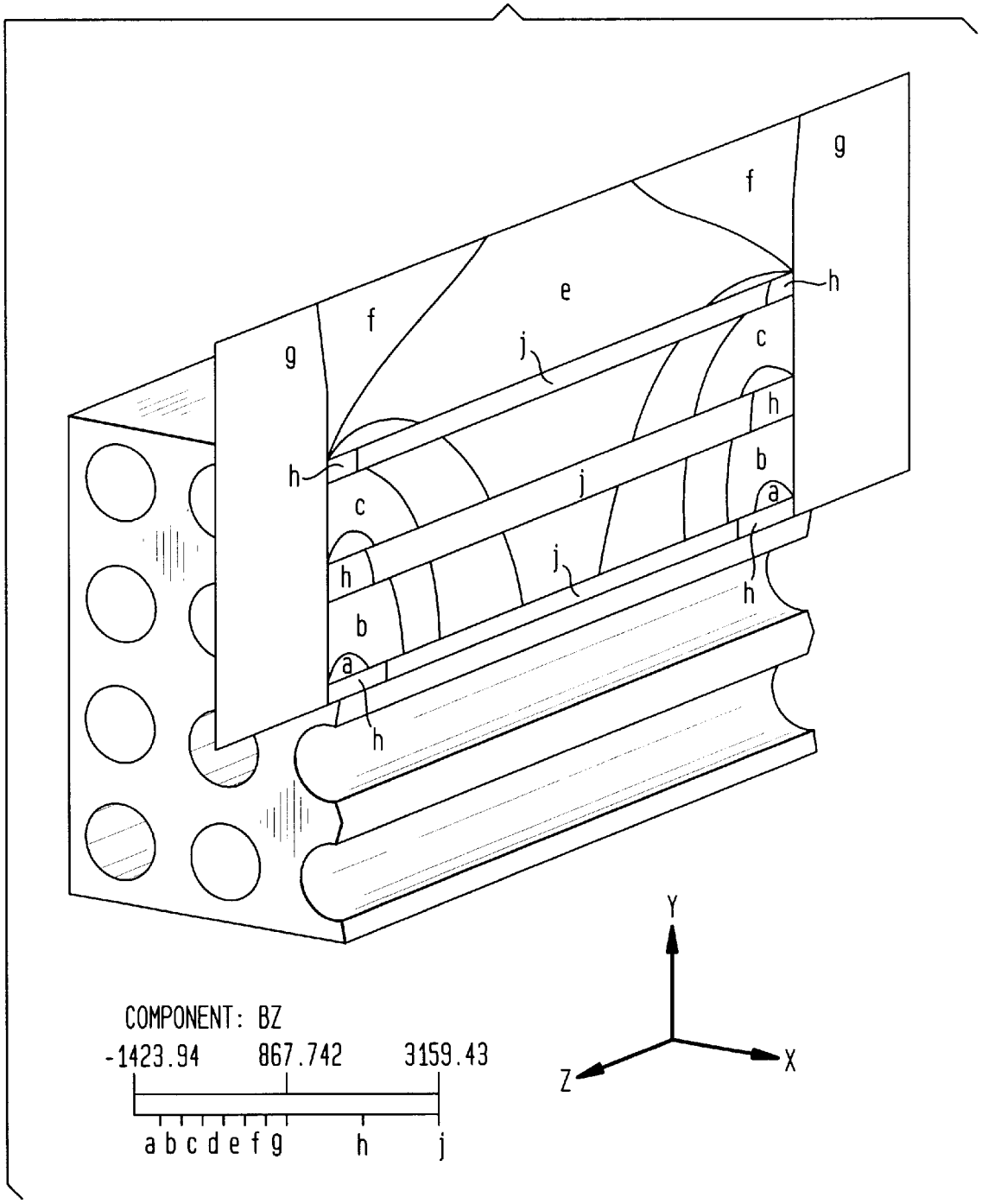
FIG. 5 is a section through the magnet of FIG. 3 showing the Z-directed magnetic field.

FIG. 5 shows a section through the magnet of FIG. 1 with a plot of the Z-directed magnetic field added. This plot shows in areas a to d the variations in flux density throughout the magnet volume. The plot of FIG. 5 obtained by solving the equations associated with a FE model is accurate in terms of representing the model of the magnet in a volume of air, but does not accurately represent the physical situation that is experienced in a display using such a magnet. The reason is that the magnet used in such a display is in fact much larger than the magnet which is modelled and the flux lines will actually have to travel much further to close around the edge of the magnet at the magnet/air interface, that is they will require greater energy.

Infinite magnet

To accurately model a full sized magnet requires constructing an FE model for every aperture in the magnet used in the display. The number of elements required to maintain solution accuracy will be many hundreds of millions. This level of calculation complexity makes solution by today's computers impossible and other means must be found in order to proceed.

Consider now a magnet of infinite extent in the X and Y dimensions, but having the same finite thickness (2 mm) in the Z direction. The magnet has air in the apertures and in the area along the Z dimension where the magnet is not present. By symmetry, it can be argued that for the magnetic material associated with each identical aperture, the magnetic field straying to adjacent associated magnetic material is exactly countered by an equal field entering the associated magnetic material of interest. Further, since flux lines cannot cross, it can be argued that each associated area is entirely self contained in terms of the magnetic fields. Thus, when investigating an infinite magnet, it is sufficient to model only a single aperture and its associated magnetic material to provide a complete solution for the whole infinite sheet.

Figure 6:
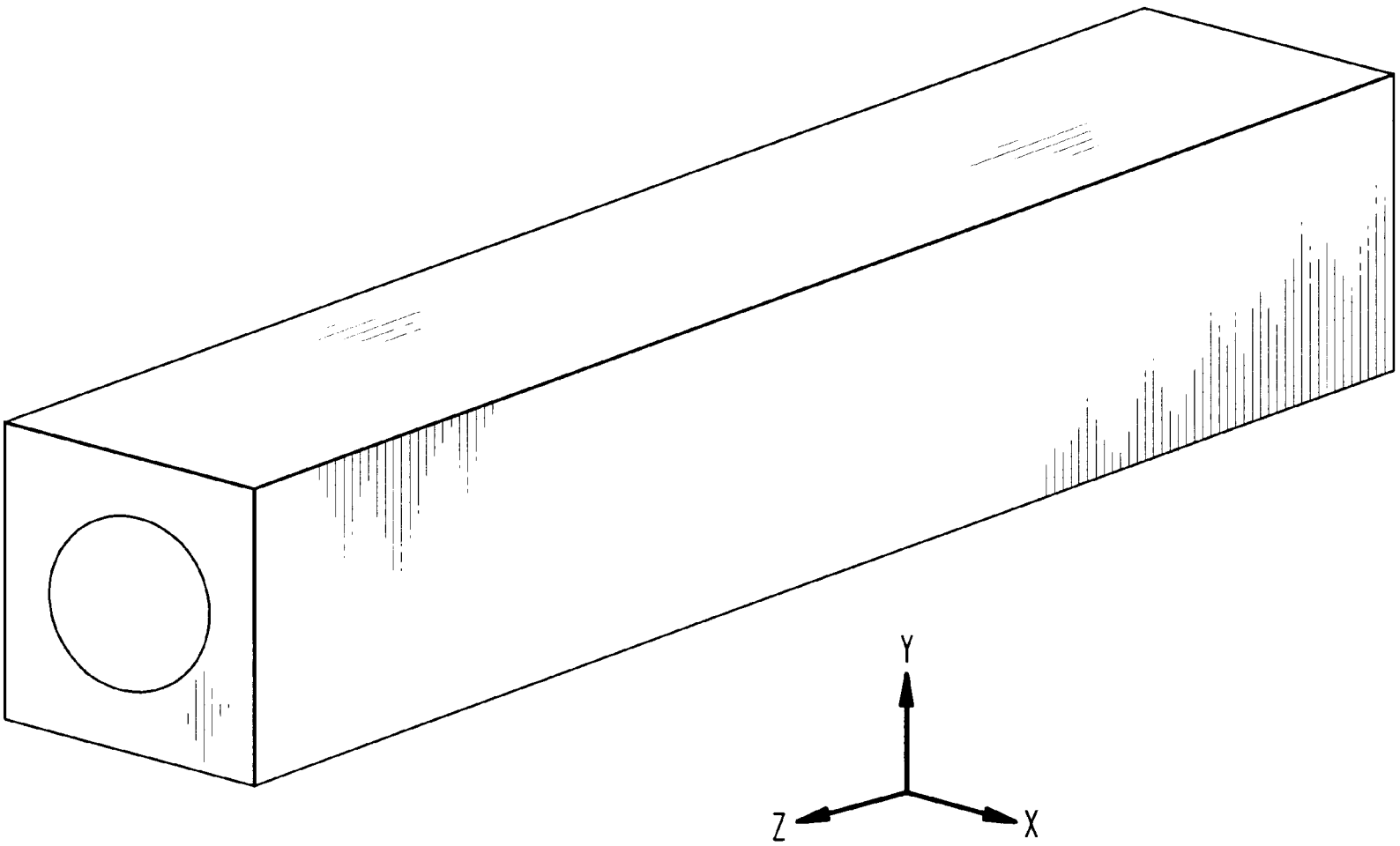
FIG. 6 is a view of a single aperture and associated magnetic material.

FIG. 6 shows such an aperture and its associated magnetic material. In the FE model of FIG. 6, following the reasoning given above, the boundary conditions are set such that the outside faces are defined to not permit any flux leakage. Further, the midplane of the magnet (the plane containing the X and Y axes) is defined to have boundary conditions such that flux lines only pass through the boundary at right angles, that is the field is solely a Z directed field.

Figure 7:
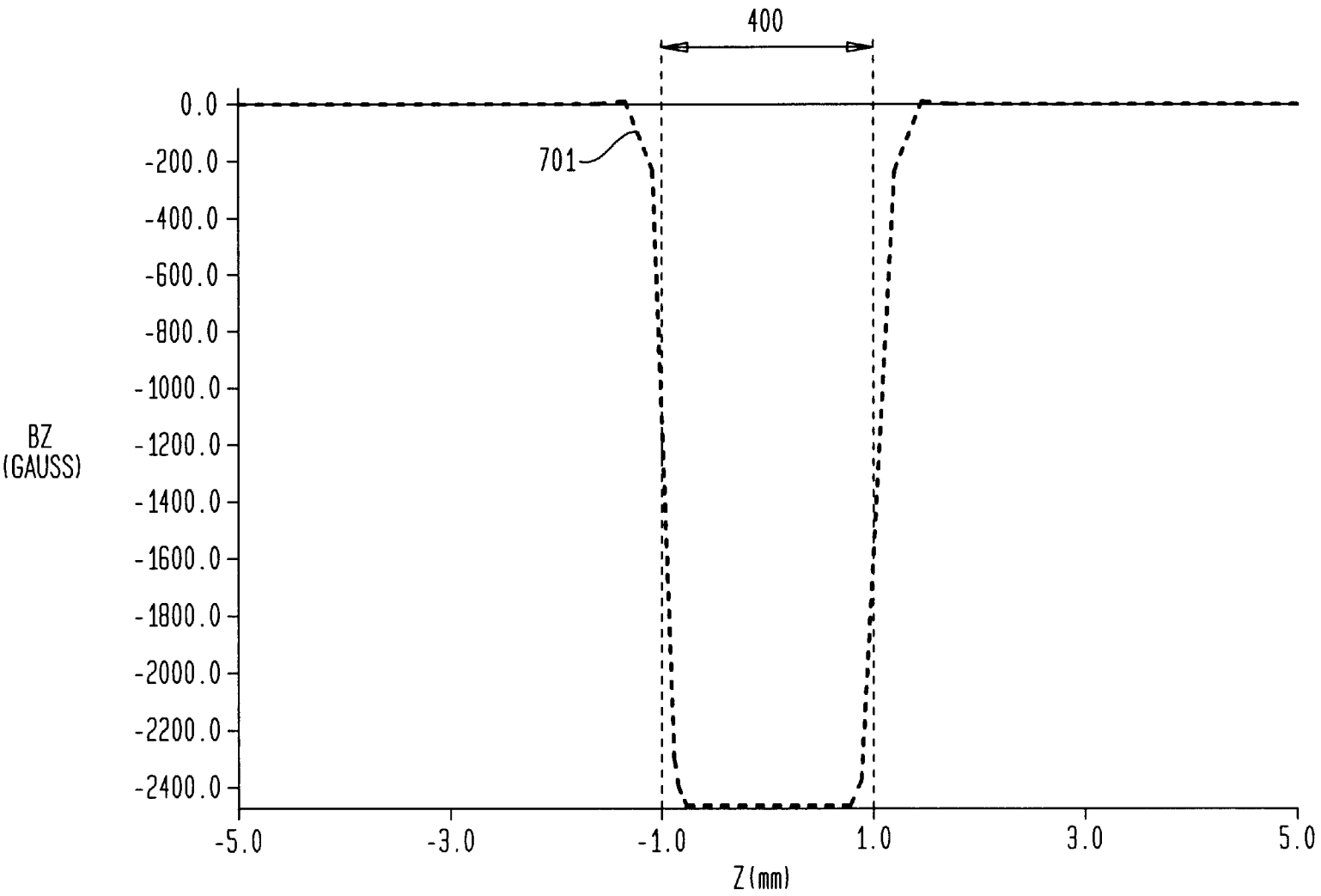
FIG. 7 is a graph of the magnetic flux density (BZ) along the Z axis of the magnet of FIG. 6.

FIG. 7 shows a graph of the Z directed component of the magnetic field from the model of FIG. 6. This graph corresponds to that of FIG. 4 for the model of FIG. 3. From FIG. 7 it can be seen that:

(i) the flux density through the aperture is essentially linear; and (ii) there is a very low flux density outside the immediate volume of magnetic material.

Additionally, since only a single aperture has been modelled to represent apertures in a magnet of infinite extent, the flux density in each of the apertures is identical. This and (i) and (ii) above are in contrast to the graphs of FIG. 4.

Figure 8:
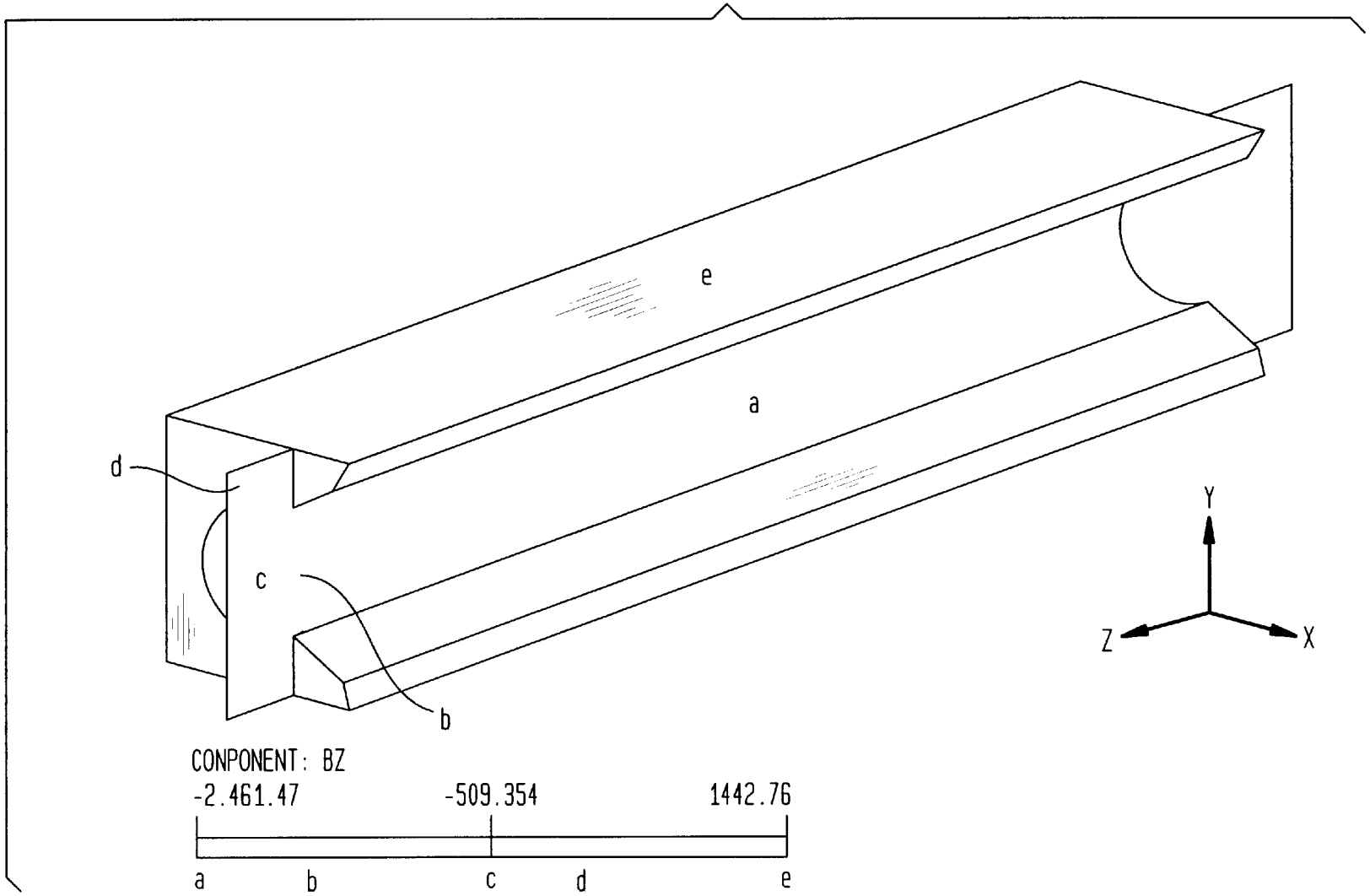
FIG. 8 is a section through the magnet of FIG. 6 showing the Z-directed magnetic field.

FIG. 8 shows a section through the magnet of FIG. 6 with a plot of the Z-directed magnetic field added. Note now that the flux density in the aperture is essentially unchanged over its length. Also note that the flux density in the material is substantially lower (1442 Gauss (0.1442T) maximum rather than 3159 Gauss (0.3159T) maximum) than in the small magnet of FIG. 3.

These differences are explained by considering the behaviour of the flux lines themselves. Firstly, air has a relative permeability of 1, that is, air is a medium highly resistant to the passage of magnetic flux. Thus, from an energy consideration, a flux line will take the shortest possible route for closure. In the case of a finite magnet, this is both through the aperture and around the side of the magnet, with the relative fields balancing in an energy equilibrium. Flux lines hardly return through the magnetic material at all. To do so would first entail overcoming the inherent energy of the magnet and so this is not a preferred route.

Demagnetisation

With the infinite magnet of FIG. 6, for a flux line to close around the edge of the magnet it would require infinite energy. This is plainly impossible and so the fields from the magnet must balance in the volume occupied. This results in a strong flux density in the aperture. However, there are still 'surplus' flux lines and these have no choice but to return through the magnetic material itself, demagnetising the magnetic material in the process. The balance between the aperture flux density and material demagnetisation is determined by the energy of the magnet in the first instance. This is also influenced by the ratio of the aperture area to material area. Smaller apertures in a given volume will lead to a higher aperture flux densities, from energy balance considerations. Note that at no time can the aperture flux density ever exceed that of the magnetic material producing it. For example, with a vanishingly small aperture in a magnet of field strength, say 3000 Gauss (0.3T), the aperture flux density could never be greater than 3000 Gauss (0.3T).

Semi-infinite magnet

We now have the situation where we have considered the small magnet of FIG. 3 in a volume of air, and the infinite magnet of FIG. 6 with air above, below and within. Whilst these two models bound all possible models, they do not provide any insight to the behaviour of a real, finite, but large, magnet. Of particular interest are the edge effects and the way in which the field varies across the magnet.

Consider a magnet of infinite extent in Y but of finite extent in X, that is, a magnet of infinite length, but of finite width. By symmetry considerations, it may be argued that a single horizontal line of pixels may be extracted from an infinite strip and by setting the appropriate boundary conditions on the computer simulation, an accurate assessment of fields made. Further, since the number of elements required to undertake this modelling is manageable, the magnet/air interface may be included in the model such that the edge effects on aperture flux density may be examined. Increases in the total number of pixels that may be modelled are to be found by using all planes of symmetry. These planes are:

1. Modelling only half of the horizontal strip, from the centre of the strip to the magnet/air interface. This is a plane in the YZ dimensions.
2. Modelling only half the depth of the strip. The field above the magnet will be equal in magnitude, but opposite in direction to that below the magnet. This is a plane in the XY dimensions.
3. Modelling only half the width of the aperture. Cut the aperture and magnet in two across the diameter of the apertures. This is a plane in the XZ dimensions.

These measures provide an eight-fold reduction in the number of elements required, or conversely, provide an eight-fold increase in the number of pixels that can be modelled as part of the strip. For example, if without symmetry a line of 64 pixels can be modelled, then with the addition of symmetry planes, 512 pixels can be modelled. An important point to note is that this represents half the width of a 1024×768 pixel display.

Figure 9:
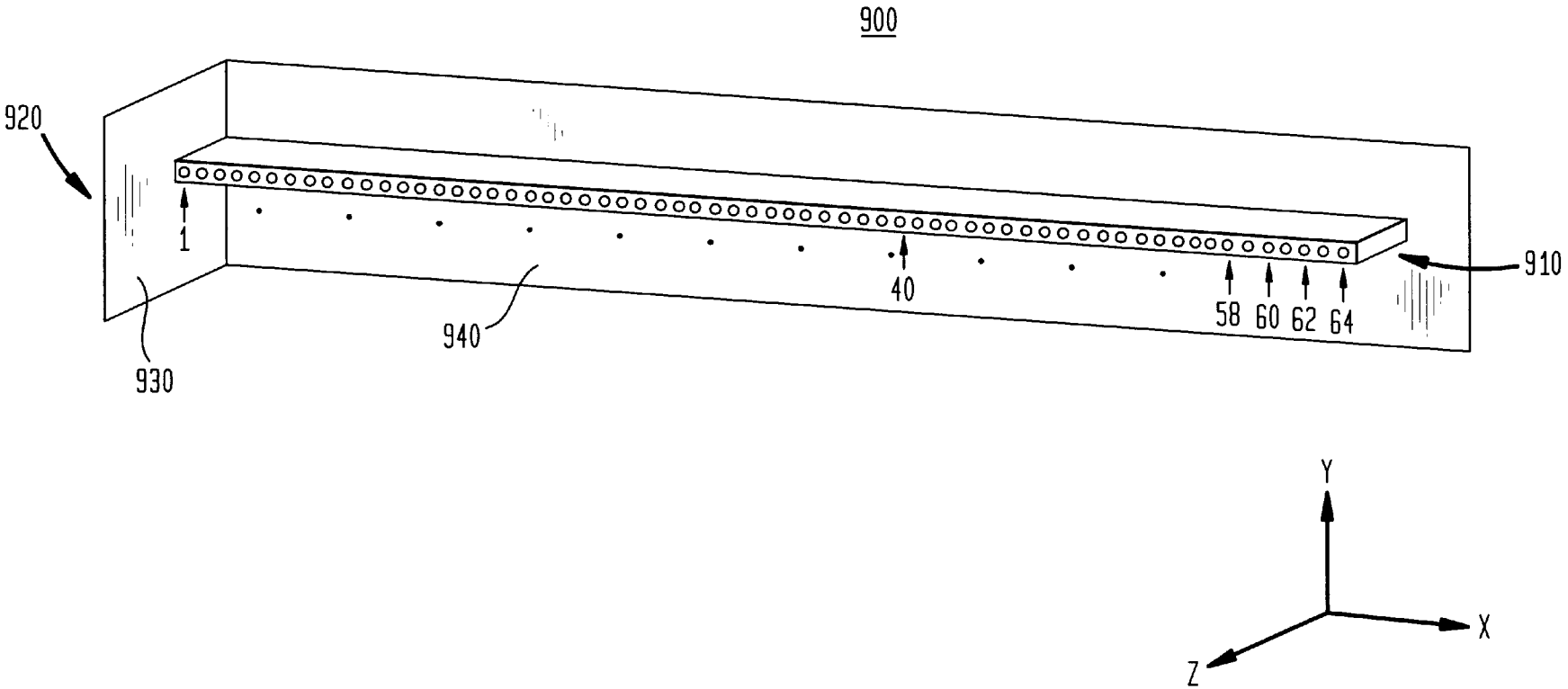
FIG. 9 is a view of a line of 64 apertures extracted from an infinite strip of apertures.

FIG. 9 shows a magnet 900 having a line of 64 apertures extracted from an infinitely long strip of apertures. In FIG. 9 only two planes of symmetry have been used. A plane 930 in YZ has been used, so that only half of the strip from the centre at 920 to the magnet/air interface at 910 has been modelled. By symmetry plane 930, the line of 64 apertures is really modelling a line of 128 apertures. A plane 940 in XY has also been used, so that only half the depth of the strip has been modelled. The apertures are numbered from 1 at the end 920 nearest the plane of symmetry to 64 at the end nearest the magnet/air interface 910.

Figure 10:
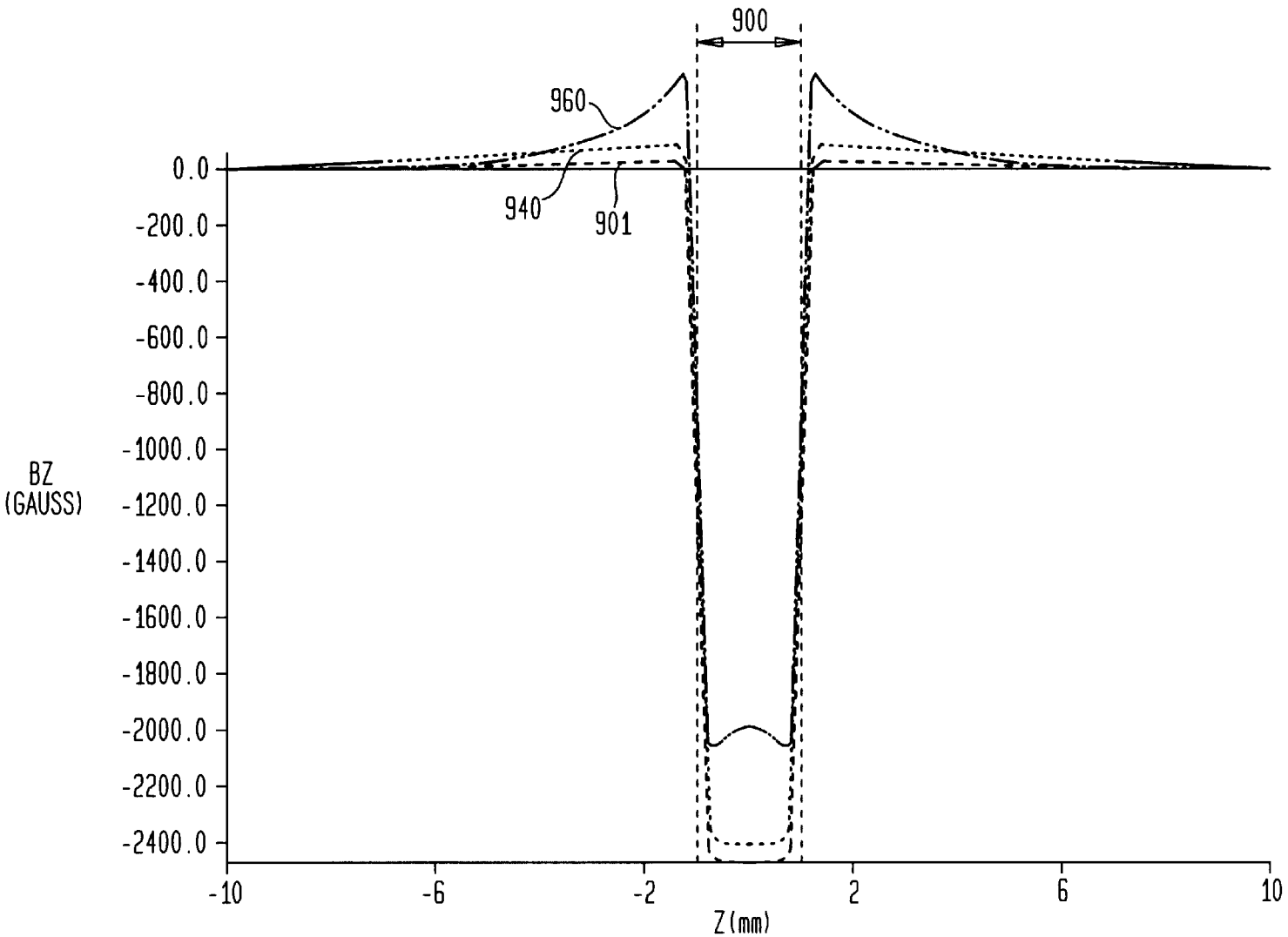
FIG. 10 is a graph showing the Z-directed magnetic field for the 1st, 40th and 60th apertures of the magnet of FIG. 9.

FIG. 10 shows three graphs 901, 940, 960 of the Z directed field in Gauss for the 1st, 40th and 60th apertures respectively of the magnet of FIG. 9 versus the position along the Z axis in mm. The magnet 900 of FIG. 9 is located along the horizontal axis of the graph in the area labelled as 900. The vertical dash lines at each end of the area labelled 900 represent the boundary between the magnet and the volume of air surrounding the magnet 900 at the upper and lower faces. The apertures have their longitudinal axis along the horizontal axis of the graph. As can be seen, the field at the first aperture is fairly close to that seen in the infinite magnet model of FIG. 6. However, as the edge of the magnet is approached, so the field tends to change towards that of the small but finite magnet of FIG. 3. The change in the graphs of the Z directed field for the 1st and 40th aperture (901 and 940) is small, indicating that any changes across the display area tend to be near the magnet edges.

Figure 11:
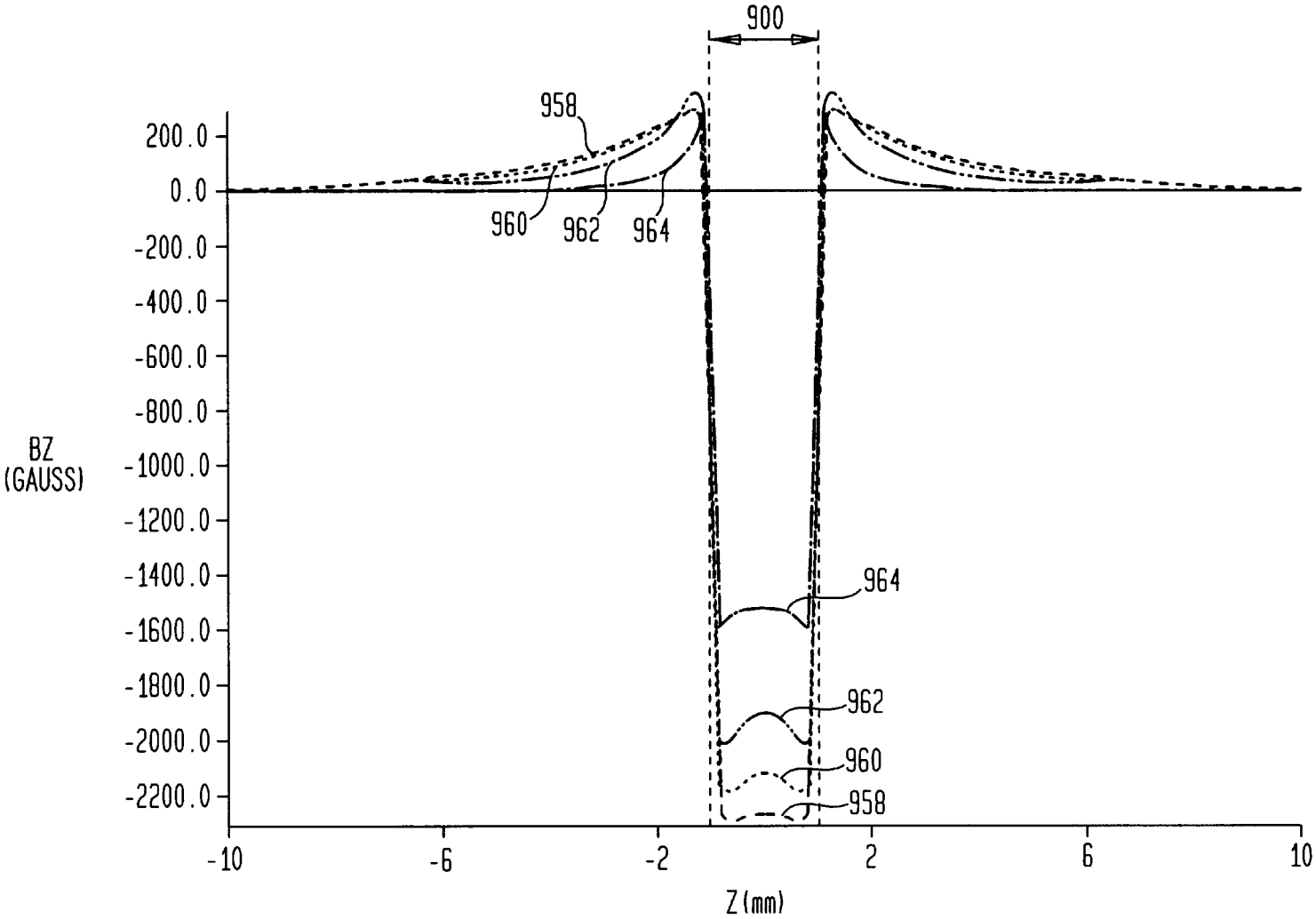
FIG. 11 is a graph showing the Z-directed magnetic field for the 58th, 60th, 62nd and 64th apertures of the magnet of FIG. 9.

FIG. 11 shows four graphs 958, 960, 962, 964 of the Z directed field for the 58th, 60th, 62nd and 64th apertures respectively of the magnet of FIG. 9. These graphs show the changes in aperture flux near the magnet edge in greater detail. As can be seen, the flux density reduction increases rapidly near the edge of the magnet 900. A magnet having the Z directed fields shown in the graphs would result in a severe beam disturbance when used in a magnetic matrix display. This would lead to the unwanted effects described earlier.

Figure 12:
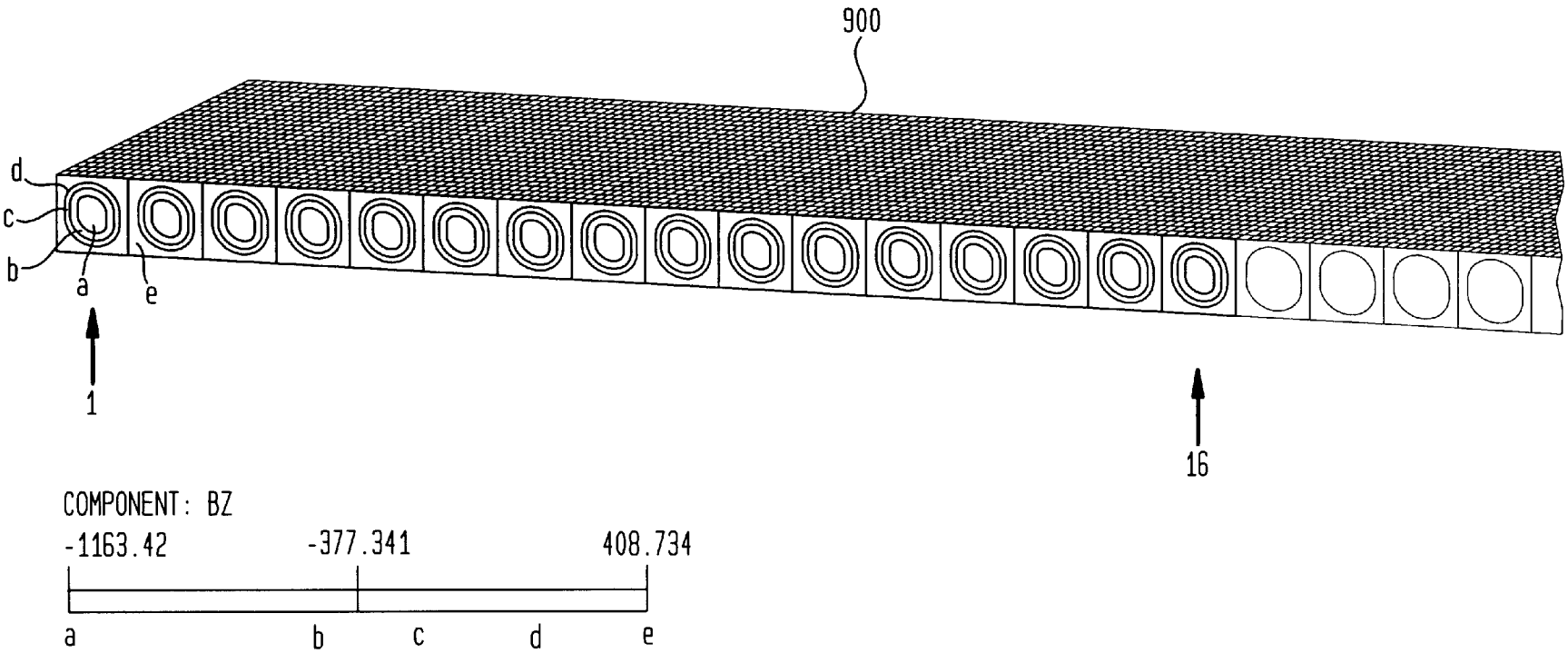
FIG. 12 is a view of the first 16 apertures of the magnet of FIG. 9, showing the Z-directed flux density.

FIG. 12 shows the Z directed flux density just above the surface of the magnet of FIG. 9. In FIG. 12 the apertures numbered 1 to 16 are shown. As can be seen the Z directed flux density does not vary to any great extent between aperture 1 and aperture 16. The flux density above the apertures has a peak value of −1163G (−0.1163T) and above the magnetic material has a peak value of 408G (0.0408T).

Figure 13:
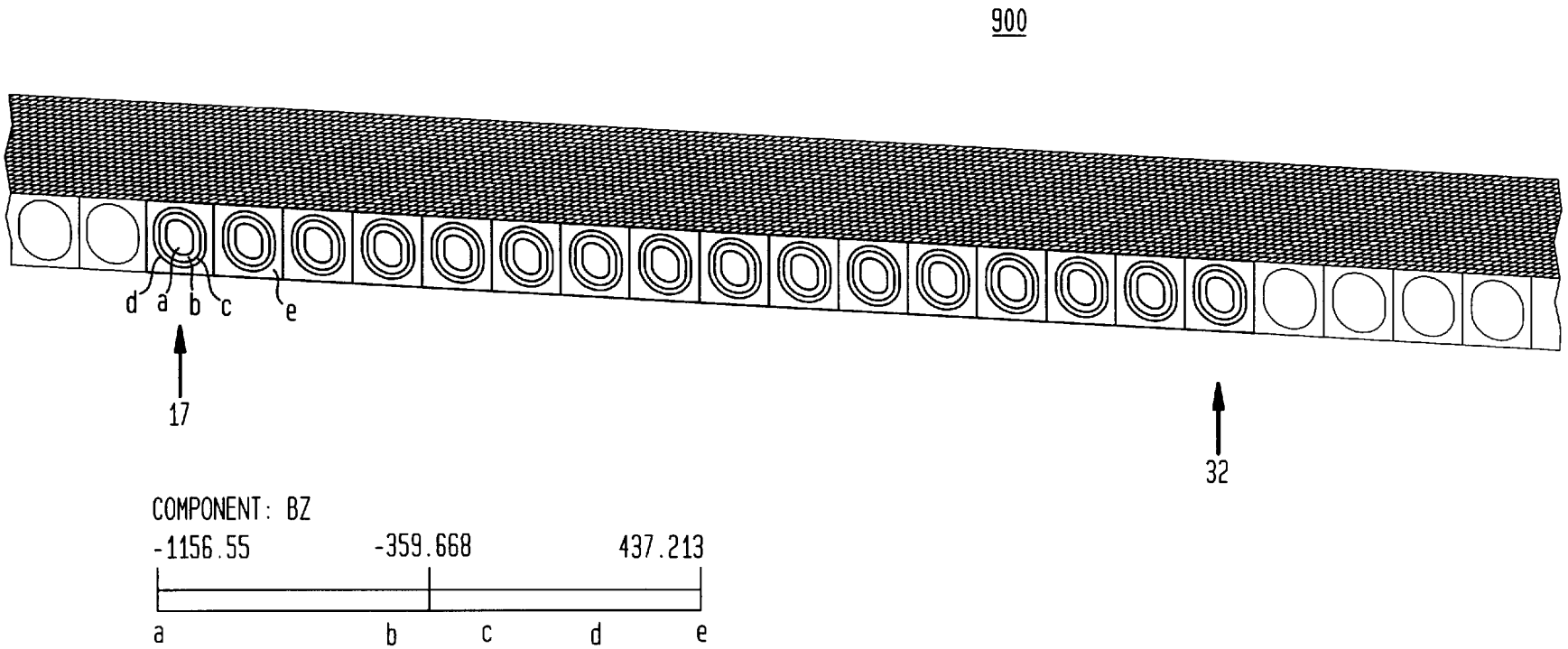
FIG. 13 is a view of the second 16 apertures of the magnet of FIG. 9, showing the Z-directed flux density.

FIG. 13 shows the Z directed flux density just above the surface of the magnet of FIG. 9. In FIG. 13 the apertures numbered 17 to 32 are shown. As can be seen the Z directed flux density does not vary to any great extent between aperture 17 and aperture 32, although a gradual decrease in the peak value of the flux density above the apertures to −1156G (−0.1156T) can be seen accompanied by an increase in the peak value of the flux density above the magnetic material itself to 437G (0.0437T).

Figure 14:
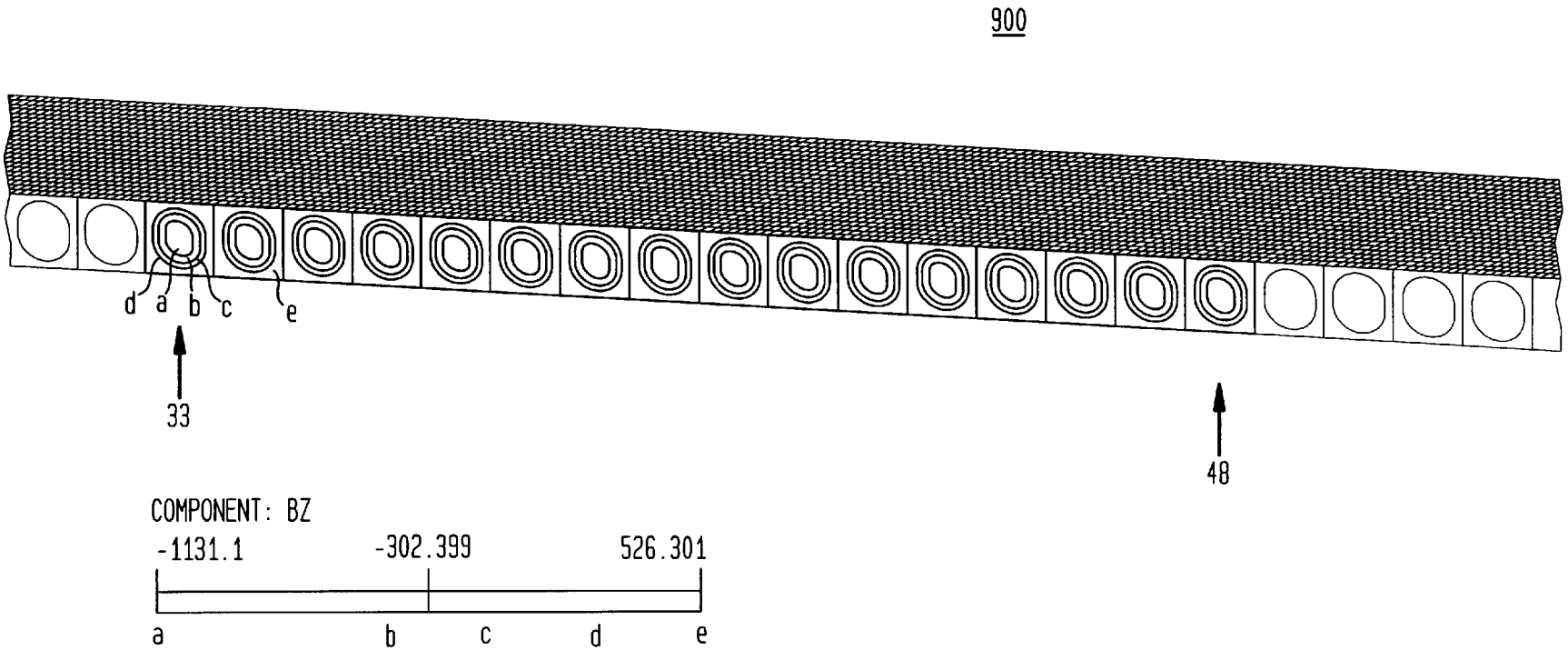
FIG. 14 is a view of the third 16 apertures of the magnet of FIG. 9, showing the Z-directed flux density.

FIG. 14 shows the Z directed flux density just above the surface of the magnet of FIG. 7. In FIG. 14 the apertures numbered 33 to 48 are shown. As can be seen the Z directed flux density does not vary to any great extent between aperture 33 and aperture 48, although a further decrease in the flux density above the apertures to a peak value of −1131G (−0.1131T) can be seen accompanied by a significant increase above the flux density in the magnetic material itself to a peak value of 526G (0.0526T).

Figure 15:
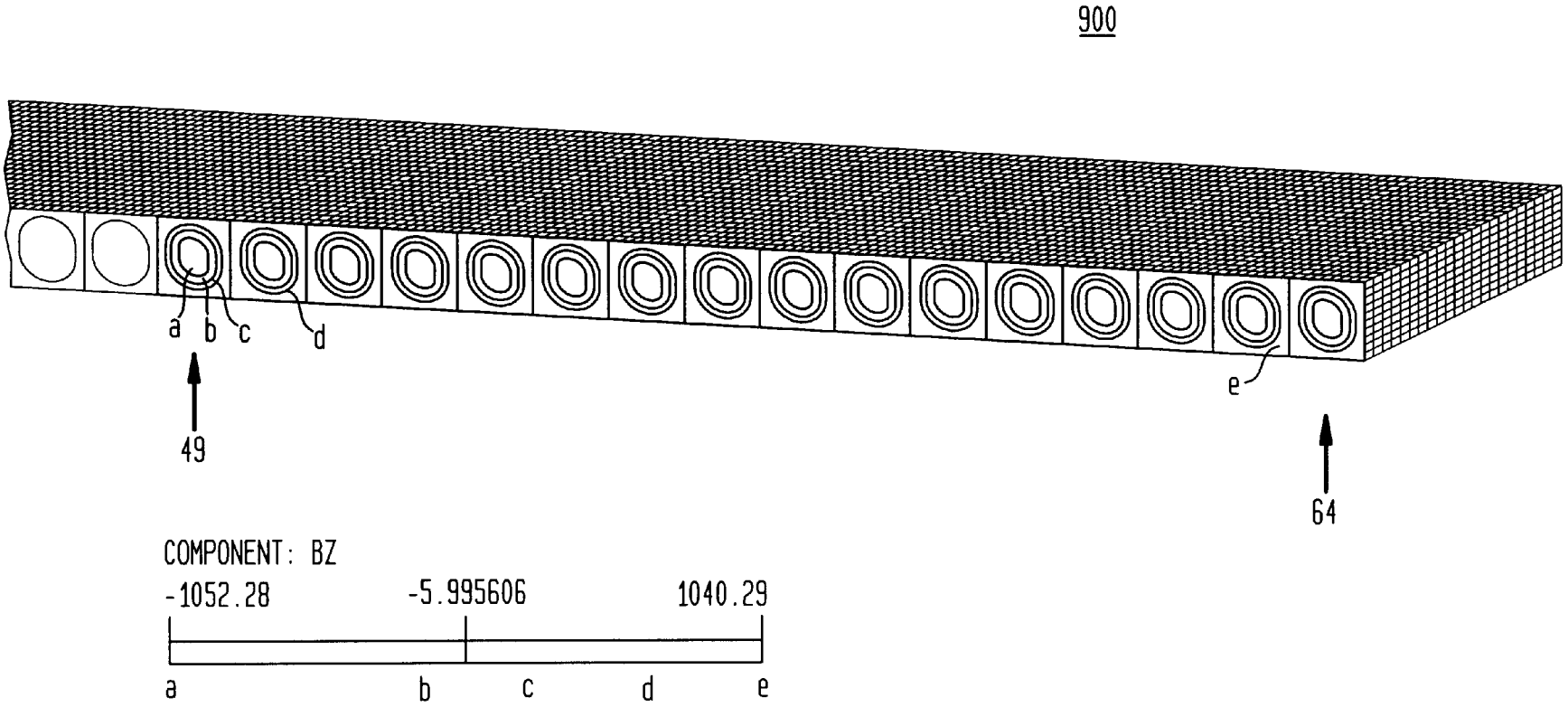
FIG. 15 is a view of the fourth 16 apertures of the magnet of FIG. 9, showing the Z-directed flux density.

FIG. 15 shows the Z directed flux density just above the surface of the magnet of FIG. 9. In FIG. 15 the apertures numbered 49 to 64 are shown. As can be seen the Z directed flux density does vary to a considerable extent between aperture 49 and aperture 64. A yet further decrease in the flux density above the apertures to a peak value of −1052G (−0.1052T) can be seen accompanied by almost double the flux density above the magnetic material itself at a peak value of 1040G (0.104T).

Figure 16:
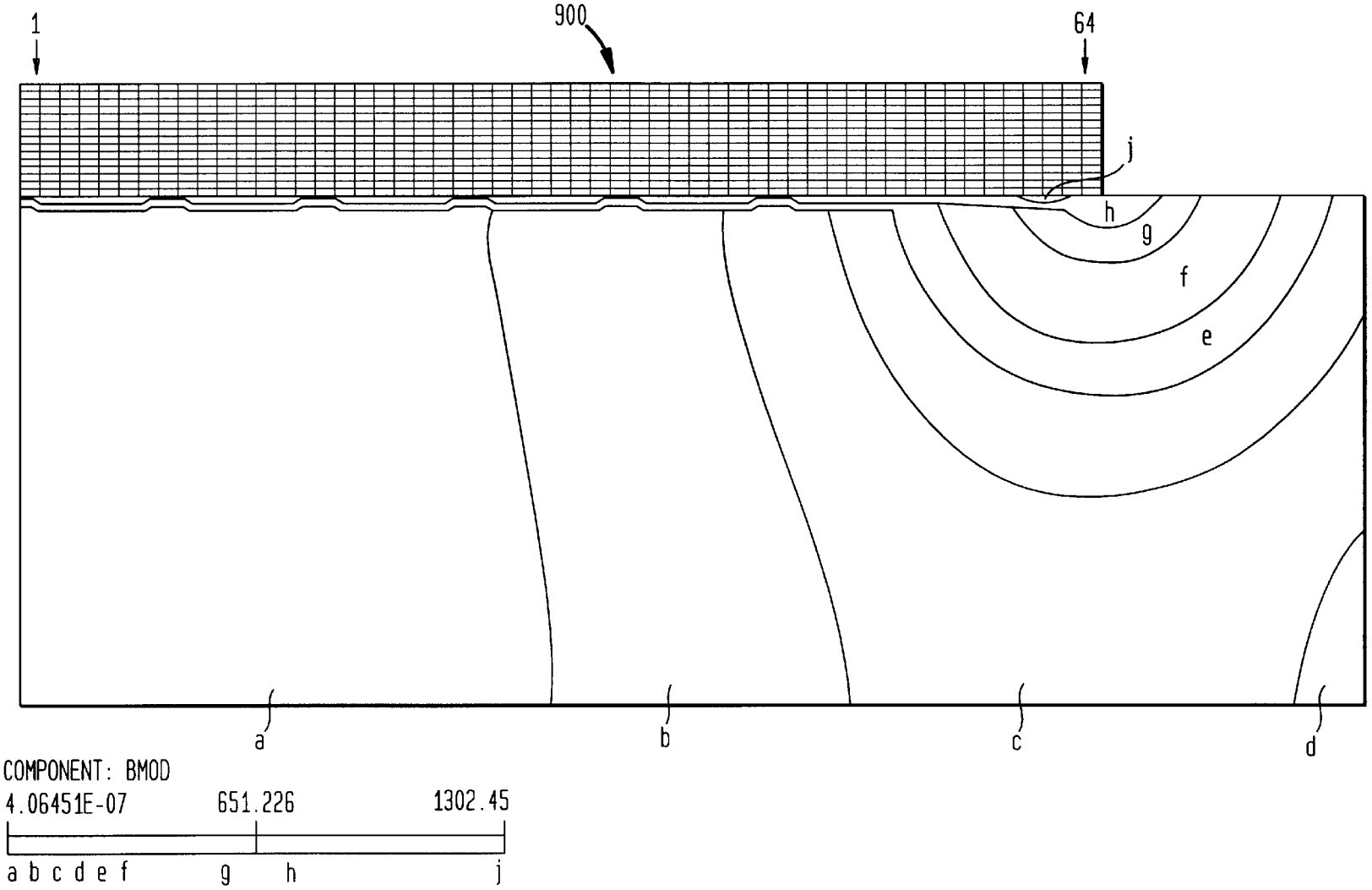
FIG. 16 is a section view of the magnet of FIG. 9 showing the field in front of the magnet.

FIG. 16 shows the modulus of the field intensity in front of the magnet 900. The magnet 900 is shown in cross section with aperture 1 at the left hand edge and aperture 64 at the right hand edge. The contour shading clearly shows the field non-linearity.

This part of the description has shown how it is possible, by using the boundary conditions and by problem symmetry, to investigate the behaviour of a large area magnet by consideration of small sections of the magnet. The fields of the magnets of FIGS. 3, 6 and 9 have been described. The way in which the field varies as the edge of the magnet is approached can be quantified and the present invention now to be described provides a means by which this variation can be reduced.

Semi-infinite magnet with keeper ring.

The edge effects in a large area magnet such as that of FIG. 9 are due to the closure of flux lines taking the easiest route. By making closure of the flux lines around the edge of the magnet more difficult, this preferential route will be avoided, causing more of the flux lines to close through the apertures and providing a flux density which is more uniform between apertures.

Figure 17:
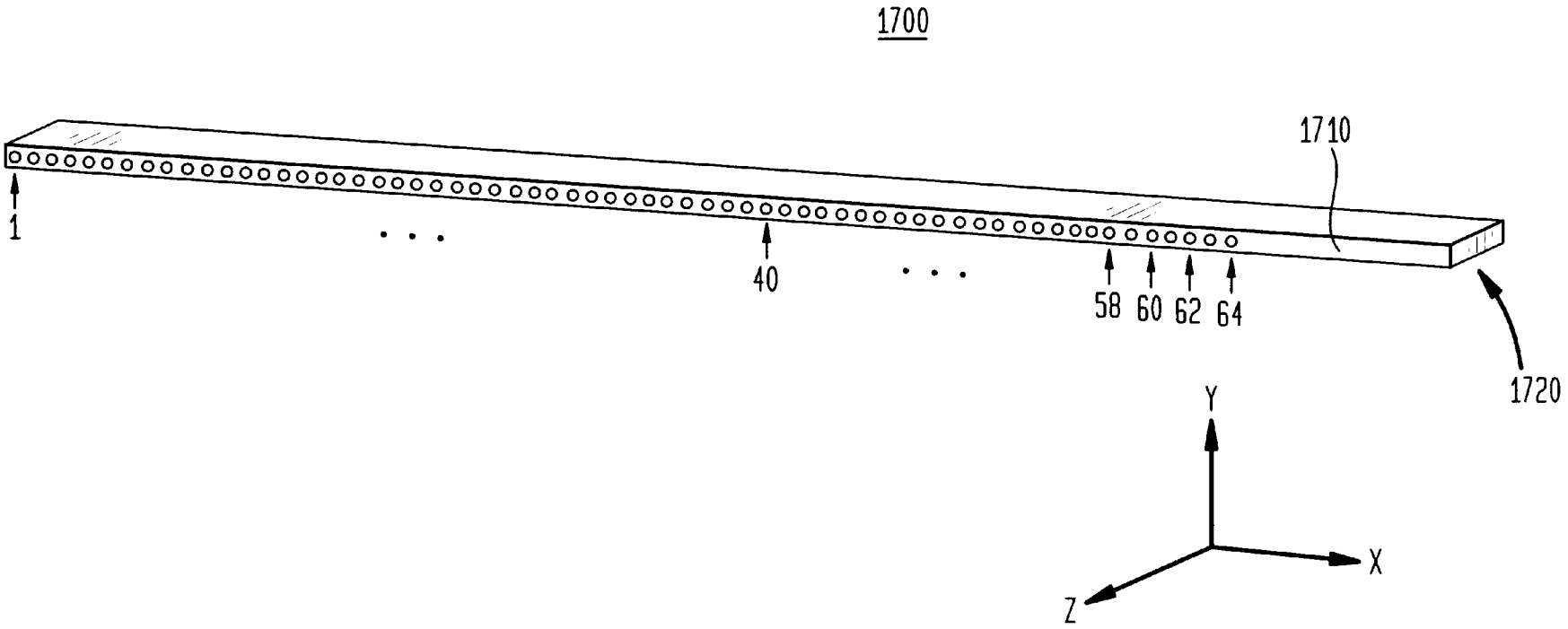
FIG. 17 is a view of a line of 64 apertures extracted from an infinite strip of apertures, having a keeper ring according to the present invention.

FIG. 17 shows a magnet 1700 according to the present invention. The magnet 1700 is similar to the magnet 900 of FIG. 9, but with the addition of a 'keeper' ring 1710 between the last aperture (aperture 64) and the edge of the magnet 1720. The purpose of the keeper ring is to produce a region of strong field which will tend to dominate at the edge of the magnet, so making it more difficult for lines of magnetic flux associated with the pixels to close around the edge of the magnet. In other words, its function is to linearise the field in the active region of the display.

Figure 18:
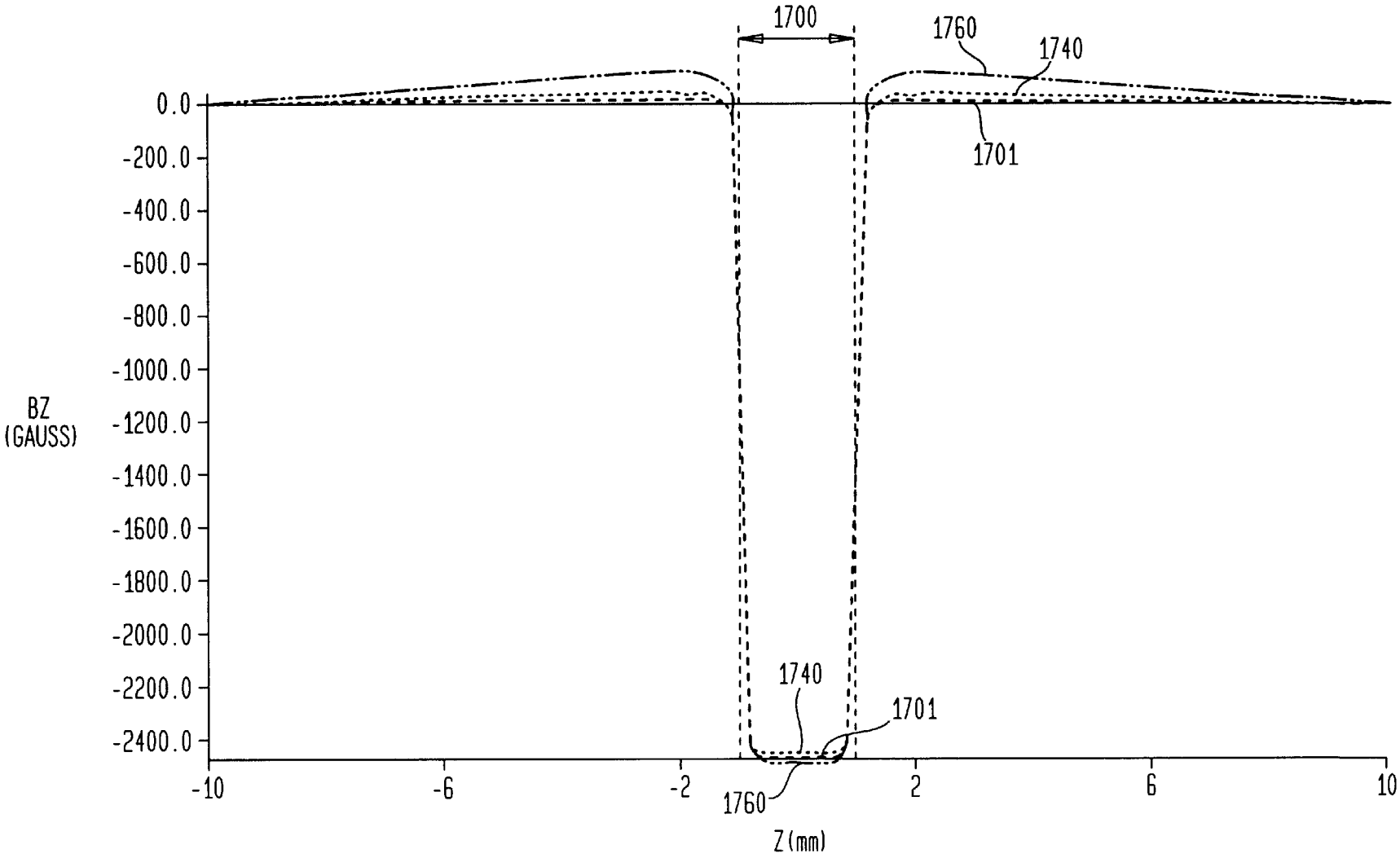
FIG. 18 is a graph showing the Z-directed magnetic field for the 1st, 40th and 60th apertures of the magnet of FIG. 17.

FIG. 18 shows three graphs 1701, 1740, 1760 of the Z directed field in Gauss for the 1st, 40th and 60th apertures respectively of the magnet 1700 of FIG. 17 versus the position along the Z axis in mm. The magnet 1700 of FIG. 17 is located along the horizontal axis of the graph in the area labelled as 1700. The vertical dash lines at each end of the area labelled 1700 represent the boundary between the magnet and the volume of air above and below the magnet 1700. The graphs correspond to those of FIG. 10 for the magnet 900 of FIG. 9, but are for the magnet 1700 of FIG. 17. In this graph, the field reduction from the 1st aperture to the 40th aperture to the 60th aperture has been converted into a field increase. That is, the field in the 60th aperture is greater than that of the 1st aperture. This indicates that the strength of the keeper ring is too great. Reducing the width of the keeper ring reduces this effect to the point where an equilibrium can be found. At this equilibrium point, the field for the 1st, 40th and 60th aperture as well as for the other apertures will be approximately equal. The exact size of keeper ring required for any given magnet depends on all the other factors associated with the magnet such as the magnet energy, the thickness, the overall area and the ratio of aperture to magnet area per pixel. Each magnet design will require a unique keeper dimension for optimum flux linearity in the active display area. The dimension can be determined by iteratively modelling the keeper dimension until the equilibrium point is found.

Figure 19:
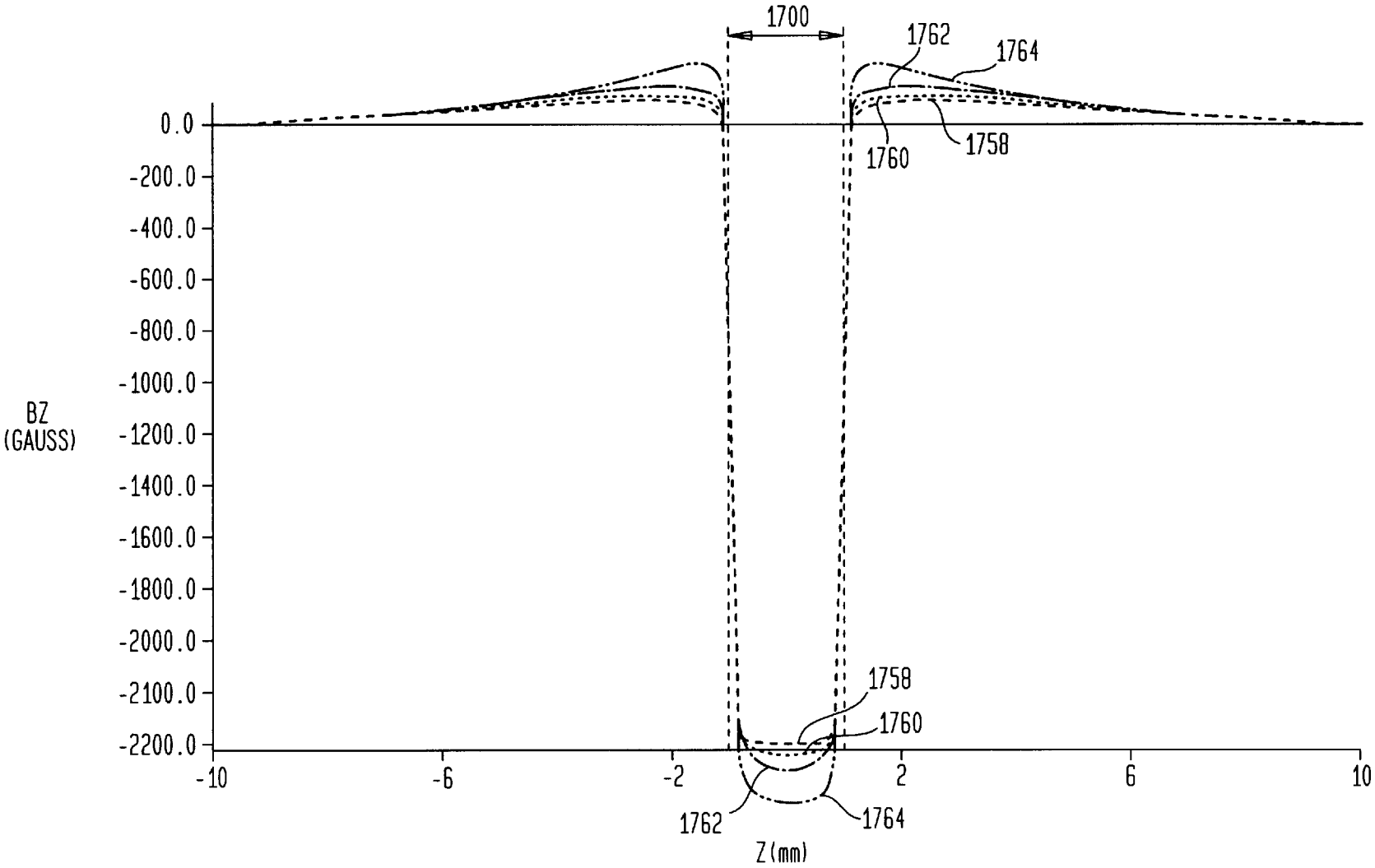
FIG. 19 is a graph showing the Z-directed magnetic field for the 58th, 60th, 62nd and 64th apertures of the magnet of FIG. 17.

FIG. 19 shows four graphs 1758, 1760, 1762, 1764 of the Z directed field in Gauss for the 58th, 60th, 62nd and 64th apertures respectively of the magnet of FIG. 17 versus the position along the Z axis in mm. These graphs show the changes in aperture flux near the magnet edge in greater detail.

Figure 20:
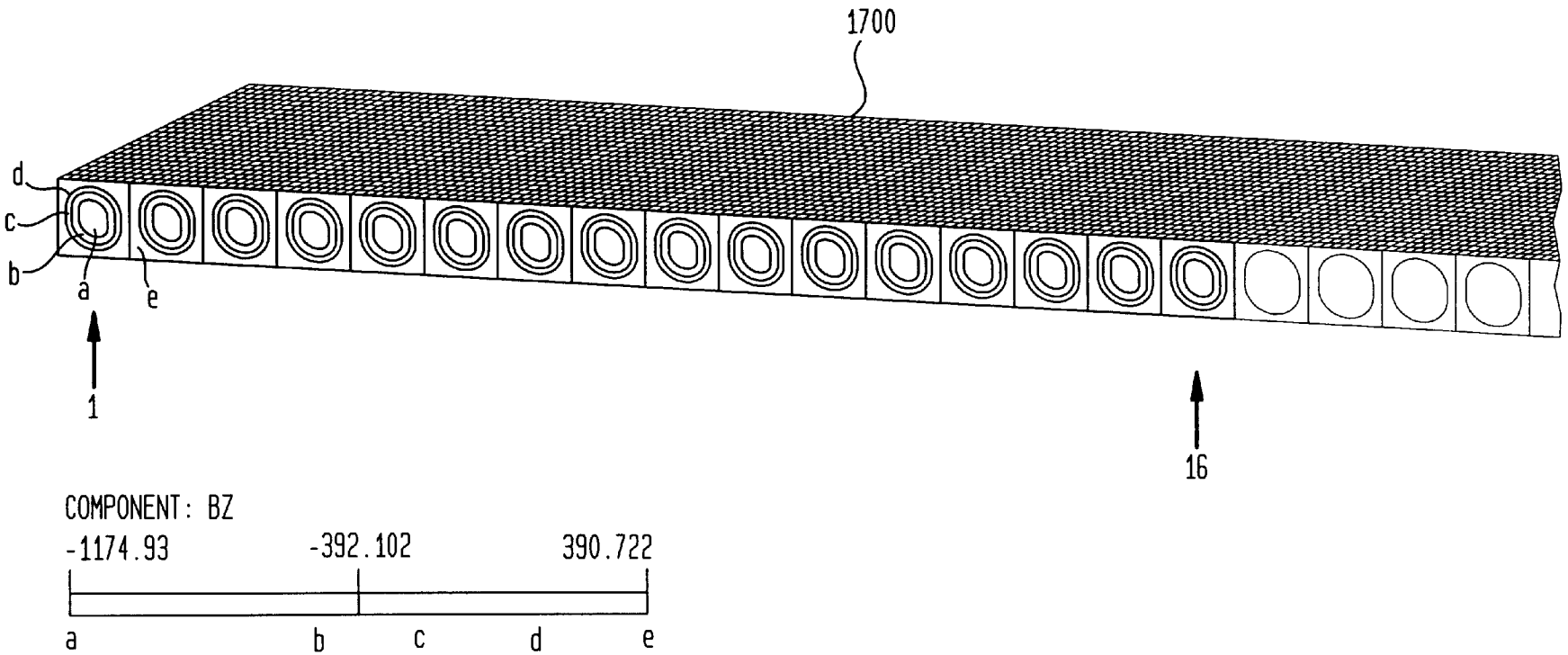
FIG. 20 is a view of the first 16 apertures of the magnet of FIG. 17, showing the Z-directed flux density.
Figure 21:
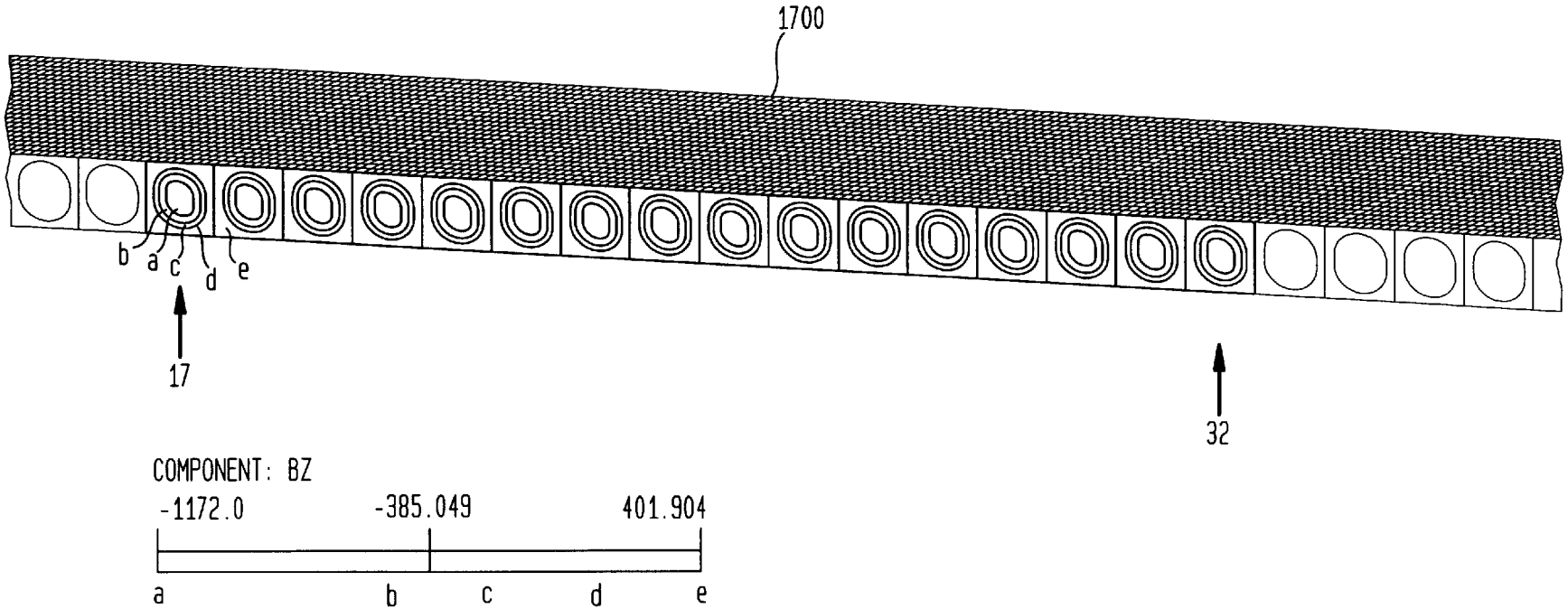
FIG. 21 is a view of the second 16 apertures of the magnet of FIG. 17, showing the Z-directed flux density.
Figure 22:
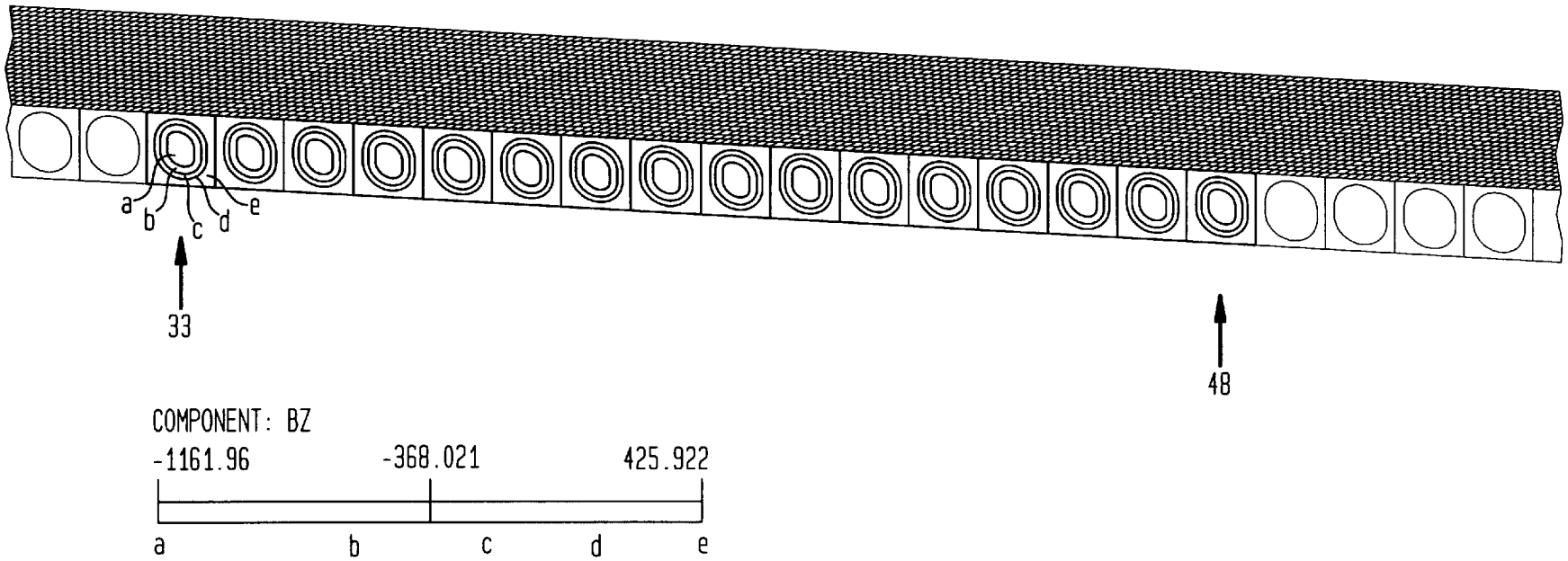
FIG. 22 is a view of the third 16 apertures of the magnet of FIG. 17, showing the Z-directed flux density.
Figure 23:
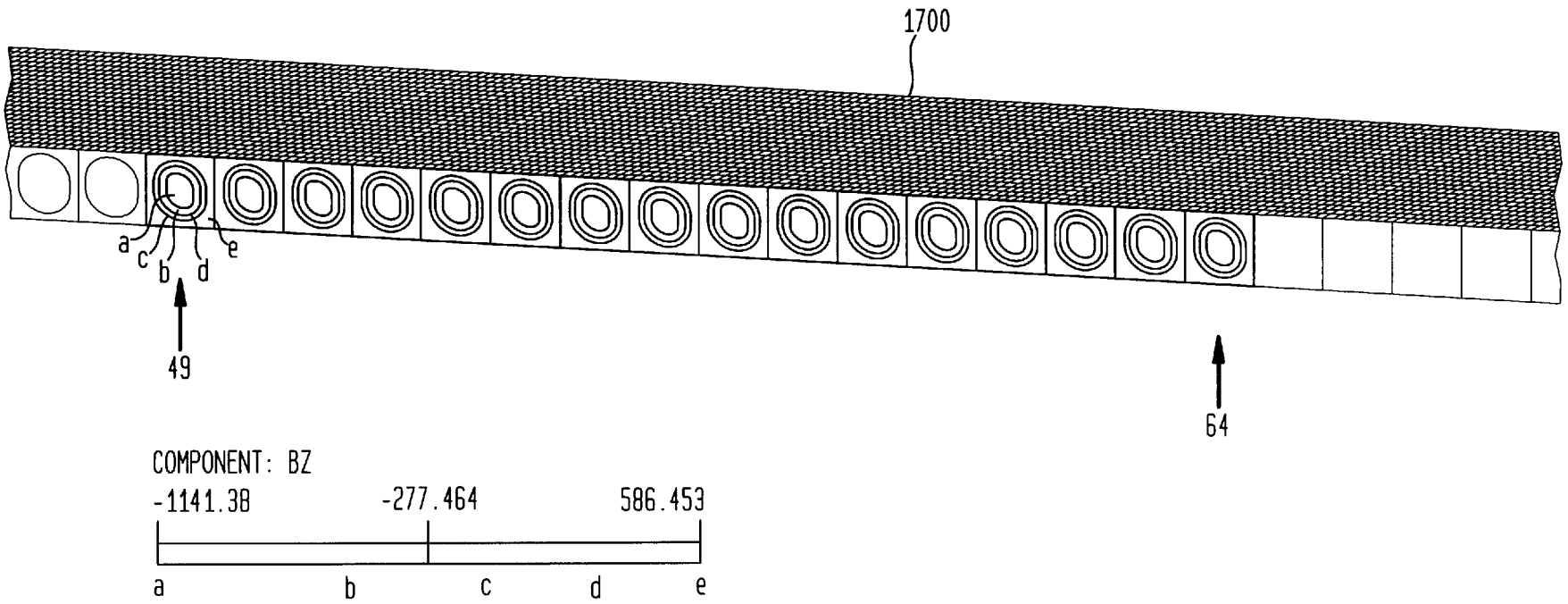
FIG. 23 is a view of the fourth 16 apertures of the magnet of FIG. 17, showing the Z-directed flux density.

FIG. 20 shows the Z directed flux density just above the surface of the magnet of FIG. 17. In FIG. 20 the apertures numbered 1 to 16 are shown. In FIG. 21 the apertures numbered 17 to 32 are shown. In FIG. 22 the apertures numbered 33 to 48 are shown. In FIG. 23 the apertures numbered 49 to 64 are shown. The peak value of flux above the apertures varies from −1174G (−0.1174T) in FIG. 20 to −1172G (−0.1172T) in FIG. 21 to −1162G (−0.1162T) in FIG. 22 and to −1141G (−0.1141T) in FIG. 23. The peak value above the magnetic material varies from 390G (0.0390T) in FIG. 20 to 401 (0.0401T) in FIG. 21 to 425G (0.0425T) in FIG. 22 to 586G (0.0586T) in FIG. 23.

As can be seen, the z directed flux density does not vary to any great extent between aperture 1 and aperture 48, although there is a small increase from 390G (0.0390T) to 425G (0.0425T) above the flux density in the magnetic material itself. Between aperture 48 and aperture 64, although the Z directed flux density above the magnetic material itself increases from 425G (0.0425T) to 586G (0.0586T), the Z directed flux density above the aperture itself decreases only slightly between apertures 49 and 64 (−1174G (−0.1174T) to −1141G (−0.1141T)).

Figure 24:
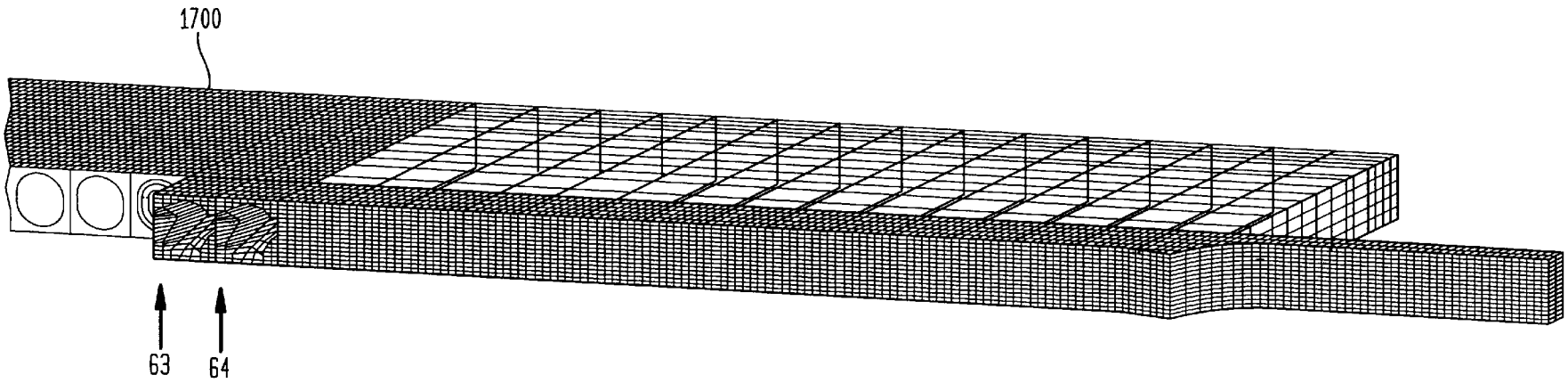
FIG. 24 is a view showing the keeper ring supporting the flux density near the edge of the magnet of FIG. 17.

FIG. 24 shows the Z directed flux in the keeper ring area and the way in which the keeper ring 'supports' the flux density near to the magnet edge. The Z directed flux in FIG. 24 is represented by the depth of the lattice frame structure shown in front of the magnet 1700. The 63rd and 64th apertures are shown in the diagram labelled as 63 and 64.

Figure 25:
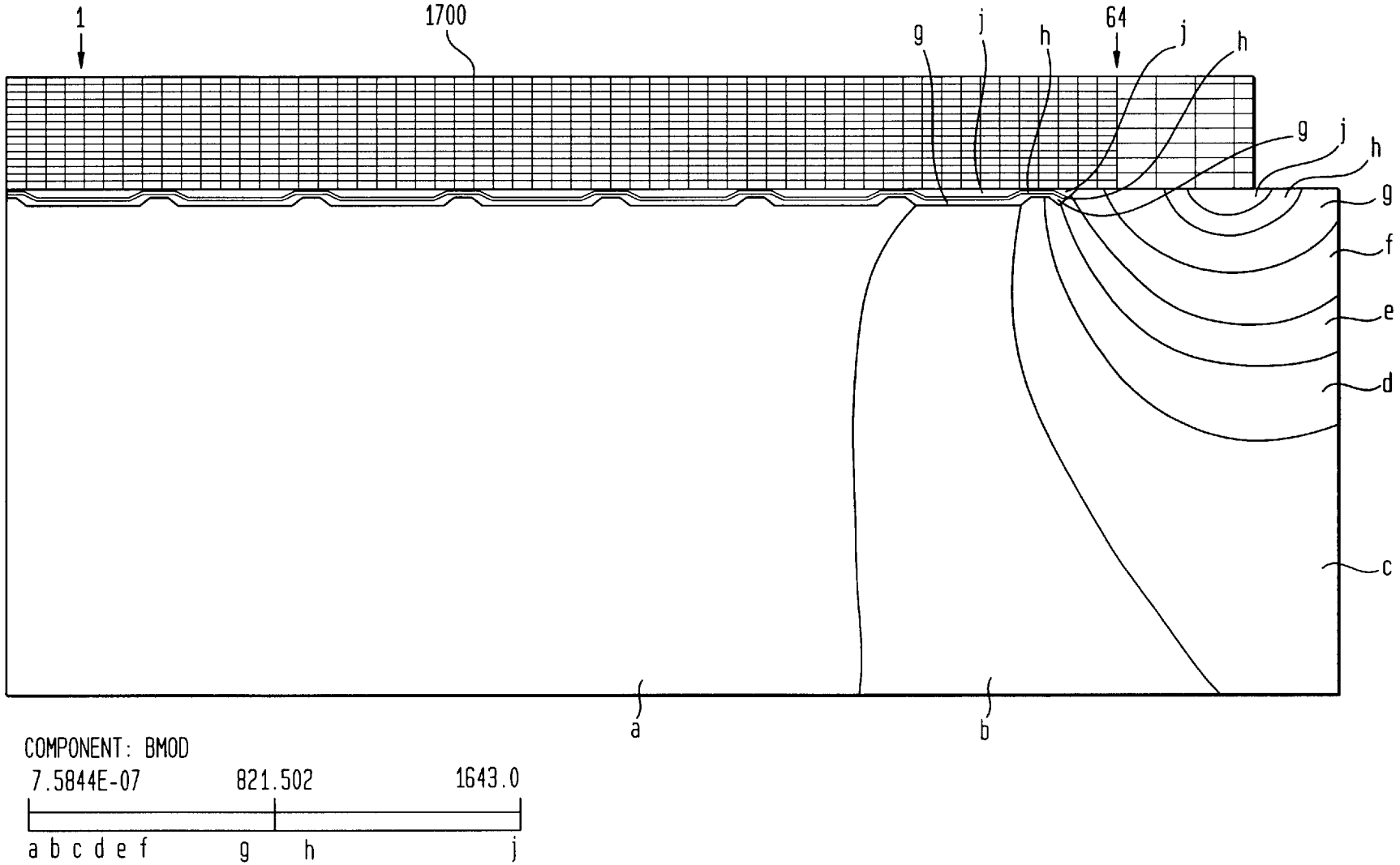
FIG. 25 is a section view of the magnet of FIG. 17 showing the field in front of the magnet.

FIG. 25 shows the modulus of the field in front of the magnet 1700. The magnet 1700 is shown in cross section with aperture 1 at the left hand edge and aperture 64 at the right hand edge. The contour shading clearly shows a small, but improved, amount of field non-linearity associated with aperture 64, but not with apertures 58 to 63. This contrasts with FIG. 16 which showed the Z directed field in front of magnet 900 with considerable field non-linearity near the magnet edge.

Figure 26A:
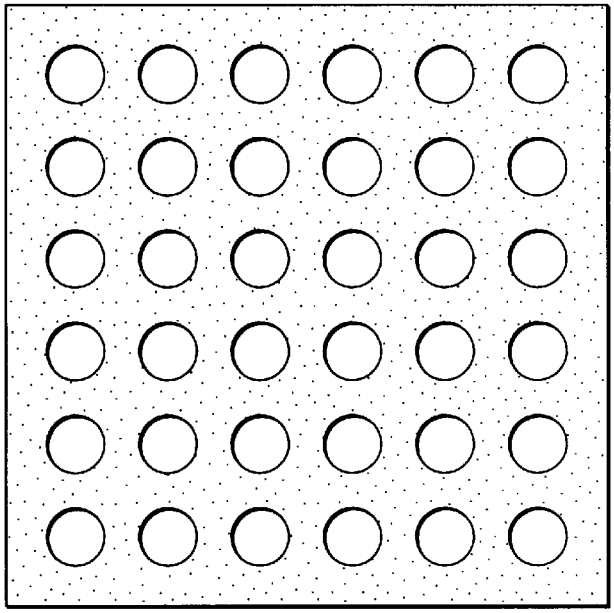
FIG. 26A shows a finite magnet similar to that of FIG. 3.
Figure 26B:
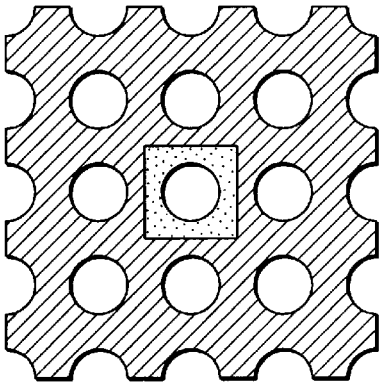
FIG. 26B shows the magnet of FIG. 9, used to model an infinite magnet.
Figure 26C:
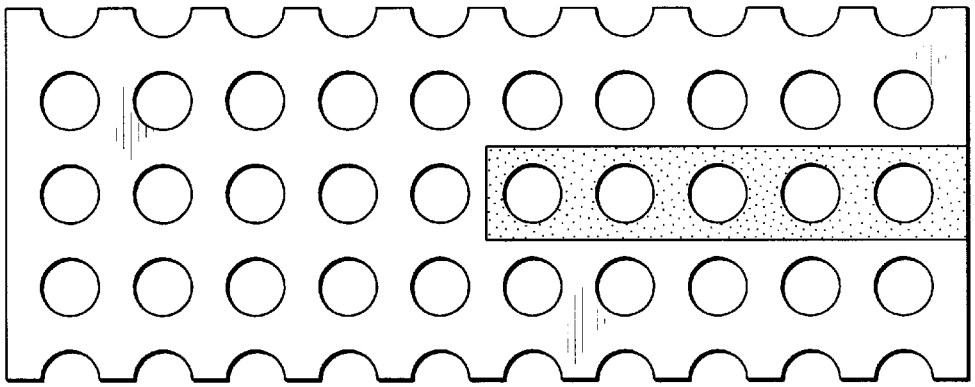
FIG. 26C shows a semi-infinite magnet similar to that of FIG. 17.

FIG. 26 summarises the three cases considered. In FIG. 26A, the shaded area indicates the extent of the complete magnet and associated apertures. The magnet is of finite extent. In FIG. 26B, the shaded area indicates a single aperture and associated magnetic material extracted from a sheet of infinite extent. In FIG. 26C, the dark area indicates a strip of pixels and associated magnetic material extracted from a strip with finite width, but infinite length. Note that from symmetry considerations, only half of the total row of pixels need be examined. Also note that the magnet/air interface is included at the edge of the strip remote from the plane of symmetry.

What has been described above is the way in which the magnetic fields balance in space about the magnet, and methods by which these fields may be evaluated by use of finite element methods. The findings indicate the presence of edge effects, leading to field non-linearities near the magnet edges. The use of a 'keeper ring' according to the present invention to counter this non-linearity has been described.

The use of such a keeper ring has a further benefit. It provides a means of mounting the magnet used in the display without obscuring any of the apertures used to form the active display area. It also provides a region outside the display area where electrical connections to the tracks formed on the magnet may be easily made. It is expected in some applications that the width of the keeper ring will be such that the driver circuits may be mounted in this region, connected to the control grids, so that the number of connections passing through the vacuum envelope is significantly reduced.

The exact dimensions of the keeper ring, having no apertures, required for any given magnet are determined by the factors mentioned above such as the magnet energy, the thickness, the overall area and the ratio of aperture to magnet area per pixel. Each magnet design will require a unique keeper dimension for optimum flux linearity in the active display area. In the event that only a small keeper ring is required to linearise the magnetic field over the active display area, additional rows and columns of apertures may be formed near the edge of the magnet surrounded by the keeper ring. These rows and columns of apertures are not used in the display for electron beam collimation purposes, but serve only to assist in field linearisation, whilst making the keeper ring large enough to allow its use for the mounting of driver circuits.

In order to ensure that no electrons are admitted to such apertures, thereby disrupting display operation, a grid 1 track may be added to these apertures and the track held at a non-select level thereby ensuring that no electrons are admitted to such apertures. Alternatively, the apertures may be physically blocked by a non-magnetic material such that the magnetic fields associated with the apertures is essentially unchanged, but that the passage of electrons is prevented.

We claim:

1. A display device comprising: cathode means for emitting electrons; a permanent magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating facing the side of the magnet remote from the cathode, the phosphor coating comprising a plurality of pixels each corresponding to a different channel; grid electrode means disposed between the cathode means and the magnet for controlling flow of electrons from the cathode means into each channel;

and wherein the magnet extends in at least one dimension of the two dimensions of said array beyond the area occupied by said array of channels such that the field strength in the channels at the periphery of the array is substantially equal to the field strength in channels at the centre of the array.

2. A display device according to claim 1, wherein the magnet extends in the two dimensions of said array such that the array of channels has a surrounding periphery of magnetic material.

3. A display device according to claim 2 wherein the size of the extended magnet is such that the channels at the periphery of the array of channels have substantially the same field strength within them as channels at the centre of the array of channels.

4. A display device according to claim 2 wherein the channels are cylindrical in shape.

5. A display device according to claim 4 wherein the channels are between 75 um and 225 um in diameter and are spaced between 100 um and 450 um apart.

6. A display according to claim 2 wherein the magnet is between 0.5 mm and 2 mm in thickness.

7. A display device according to claim 2 wherein the extended magnet area has circuits for control of the display device located thereon.

8. A display device according to claim 7 wherein the extended magnet area includes a portion of the array of channels, said portion of the array of channels having a second grid electrode means disposed between the cathode means and the magnet for preventing the admission of electrons from the cathode to the portion of the array of channels.

9. A display device according to claim 7 wherein the extended magnet area includes a portion of the array of channels, said portion of the array of channels being physically blocked with non-magnetic material so as to prevent the admission of electrons from the cathode to the portion of the array of channels.

10. A computer system comprising: memory means; data transfer means for transferring data to and from the memory means; processor means for processing data stored in the memory means; and a display device according to claim 1 for displaying data processed by the processor means.

* * * * *